US011722832B2

(12) United States Patent
Tsuji et al.

(10) Patent No.: US 11,722,832 B2
(45) Date of Patent: Aug. 8, 2023

(54) SIGNAL PROCESSING APPARATUS AND METHOD, AND PROGRAM

(71) Applicant: Sony Corporation, Tokyo (JP)

(72) Inventors: Minoru Tsuji, Chiba (JP); Toru Chinen, Kanagawa (JP); Mitsuyuki Hatanaka, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/762,304

(22) PCT Filed: Oct. 31, 2018

(86) PCT No.: PCT/JP2018/040425
§ 371 (c)(1),
(2) Date: May 7, 2020

(87) PCT Pub. No.: WO2019/098022
PCT Pub. Date: May 23, 2019

(65) Prior Publication Data

US 2021/0176581 A1 Jun. 10, 2021

(30) Foreign Application Priority Data

Nov. 14, 2017 (JP) ..... 2017-219450

(51) Int. Cl.
*H04S 7/00* (2006.01)
*H04S 3/00* (2006.01)

(52) U.S. Cl.
CPC ..... *H04S 7/302* (2013.01); *H04S 3/008* (2013.01); *H04S 7/308* (2013.01);
(Continued)

(58) Field of Classification Search
CPC ..... H04S 7/302; H04S 7/308; H04S 7/008; H04S 2400/11; H04S 2400/01; H04S 2420/01; H04S 3/008
See application file for complete search history.

(56) References Cited

U.S. PATENT DOCUMENTS 5,812,688 A * 9/1998 Gibson ..... G10H 1/0008 381/119
10,809,870 B2 * 10/2020 Tsukagoshi ..... G06F 3/0485
(Continued)

FOREIGN PATENT DOCUMENTS

CN 105075292 A 11/2015
EP 1 791 394 A1 5/2007
(Continued)

OTHER PUBLICATIONS

International Search Report and English translation thereof dated Jan. 15, 2019 in connection with International Application No. PCT/JP2018/040425.
(Continued)

*Primary Examiner* — Ping Lee
(74) *Attorney, Agent, or Firm* — Wolf, Greenfield & Sacks, P.C.

(57) ABSTRACT

The present technology relates to a signal processing apparatus and method, and a program that can easily determine a localization position of a sound image.

A signal processing apparatus includes: an acquisition unit configured to acquire information associated with a localization position of a sound image of an audio object in a listening space specified in a state where the listening space viewed from a listening position is displayed; and a generation unit configured to generate a bit stream on the basis of the information associated with the localization position. The present technology can be applied to the signal processing apparatus.

11 Claims, 12 Drawing Sheets

(52) U.S. Cl.
CPC ..... *H04S 2400/01* (2013.01); *H04S 2400/11* (2013.01); *H04S 2420/01* (2013.01)

(56) References Cited

U.S. PATENT DOCUMENTS

| | | | | |
|---|---|---|---|---|
| 2003/0053680 | A1 | 3/2003 | Lin | |
| 2012/0002024 | A1 | 1/2012 | Choi | |
| 2013/0010969 | A1 | 1/2013 | Cho | |
| 2014/0324200 | A1 | 10/2014 | Chen | |
| 2016/0337777 | A1 | 11/2016 | Tsuji et al. | |
| 2017/0238116 | A1 | 8/2017 | Mateos Sole et al. | |
| 2019/0020963 | A1* | 1/2019 | Mor | H04S 7/307 |

FOREIGN PATENT DOCUMENTS

| | | | | |
|---|---|---|---|---|
| JP | 08-181962 | A | 7/1996 | |
| JP | 2009-278381 | A | 11/2009 | |
| JP | 2014-011509 | A | 1/2014 | |
| JP | 2016-096420 | A | 5/2016 | |
| KR | 20160046924 | A | 4/2016 | |
| KR | 20160108325 | A | 9/2016 | |
| RU | 2518933 | C2 | 6/2014 | |
| RU | 2525109 | C2 | 8/2014 | |
| WO | WO 2014/085610 | A1 | 6/2014 | |
| WO | WO-2015107926 | A1 * | 7/2015 | H04S 3/008 |

OTHER PUBLICATIONS

[No Author Listed], Authoring for Dolby Atmos Cinema Sound Manual. Issue 3. 2014. 132 pages.

[No. Author Listed], International Standard ISO/IEC 23008-3. Information technology—High efficiency coding and media delivery in heterogeneous environments—Part 3: 3D audio. Feb. 1, 2016. 439 pages.

Pulkki, Virtual Sound Source Positioning Using Vector Base Amplitude Panning. J. Audio Eng. Soc. 1997;45(6):456-466.

International Written Opinion and English translation thereof dated Jan. 15, 2019 in connection with International Application No. PCT/JP2018/040425.

International Preliminary Report on Patentability and English translation thereof dated May 28, 2020 in connection with International Application No. PCT/JP2018/040425.

Extended European Search Report dated Dec. 22, 2020 in connection with European Application No. 18879892.0.

Communication pursuant to Article 94(3) EPC dated Dec. 2, 2022 in connection with European Application No. 18879892.0.

* cited by examiner

FIG. 5

| ITEM | | PARAMETER |
|---|---|---|
| ROOM SIZE | DEPTH | 6.0m |
| | WIDTH | 8.0m |
| | HEIGHT | 3.0m |
| LISTENING POSITION | | MIDDLE OF ROOM |
| SCREEN SHAPE | SIZE | 120 INCHES |
| | ASPECT RATIO | 16 : 9 |
| SCREEN POSITION | FRONT AND BACK | 2 m IN FRONT OF LISTENING POSITION |
| | LEFT AND RIGHT | MIDDLE |
| | UP AND DOWN | SCREEN CENTER IS AT HEIGHT OF LISTENER'S EAR |

SIGNAL PROCESSING APPARATUS AND METHOD, AND PROGRAM

CROSS-REFERENCE TO RELATED APPLICATIONS

This application claims the benefit under 35 U.S.C. § 371 as a U.S. National Stage Entry of International Application No. PCT/JP2018/040425, filed in the Japanese Patent Office as a Receiving Office on Oct. 31, 2018, which claims priority to Japanese Patent Application Number JP2017-219450, filed in the Japanese Patent Office on Nov. 14, 2017, each of which is hereby incorporated by reference in its entirety.

TECHNICAL FIELD

The present technology relates to a signal processing apparatus and method, and a program, and more particularly, to a signal processing apparatus and method, and a program that can easily determine a localization position of a sound image.

BACKGROUND ART

In recent years, object-based audio technology has attracted attention.

In object-based audio, object audio data includes a waveform signal with respect to an audio object and meta information indicating localization information of the audio object represented by a relative position from a listening position, which is a predetermined reference.

Then, the waveform signal of the audio object is rendered into a signal of a desired number of channels by, for example, vector based amplitude panning (VBAP) on the basis of the meta information and reproduced (see, for example, Non-Patent Documents 1 and 2).

In object-based audio, it is possible to arrange an audio object in various directions on a three-dimensional space in creating audio content.

For example, in Dolby Atoms Panner plus-in for Pro Tools (see, for example, Non-Patent Document 3), it is possible to specify the position of an audio object on a 3D graphic user interface. With this technology, a sound image of a sound of an audio object can be localized in an arbitrary direction on a three-dimensional space by designating a position on an image of a virtual space displayed on the user interface as a position of the audio object.

On the other hand, the localization of the sound image with respect to the conventional two-channel stereo is adjusted by a technique called panning. For example, the position of the sound image to be localized in the left-right direction is determined by changing the proportion ratio of a predetermined audio track to left and right two channels by a user interface (UI).

CITATION LIST

Patent Document

Non-Patent Document 1: ISO/IEC 23008-3 Information technology—High efficiency coding and media delivery in heterogeneous environments—Part 3:3D audio Non-Patent Document 2: Ville Pulkki, "Virtual Sound Source Positioning Using Vector Base Amplitude Panning", Journal of AES, Vol. 45, No. 6, pp. 456-466, 1997

Non-Patent Document 3: Dolby Laboratories, Inc., "Authoring for Dolby Atmos® Cinema Sound Manual", [online], [Searched on Oct. 31, 2017], Internet <https://www.dolby.com/us/en/technologies/dolby-atmos/authoring-for-dolby-atmos-cinema-sound-manual.pdf>

SUMMARY OF THE INVENTION

Problems to be Solved by the Invention

However, with the aforementioned technology, it is difficult to easily determine the localization position of the sound image.

That is, in either case of the object-based audio and the two-channel stereo, a creator of the audio content cannot intuitively specify the localization position of the sound image with respect to the actual listening position of the sound of the content.

For example, with the Dolby Atoms Panner plus-in for Pro Tools, any position on the three-dimensional space can be specified as the localization position of the sound image. However, when the specified position is viewed from the actual listening position, it is impossible to tell where it is.

Similarly, it is difficult to intuitively grasp the relationship between the proportion ratio and the localization position of the sound image when specifying the proportion ratio also in the case of two-channel stereo.

Therefore, the creator repeatedly adjusts the localization position of the sound image and listens to the sound at that localization position to determine the final localization position. Thus, a sense of experience is needed to reduce the number of such localization position adjustments.

In particular, in the case of adjusting the localization position of a sound to a video, e.g., localizing the voice of a person at the position of the mouth of the person shown on a screen to make the voice come out of the mouth of the video, it has been difficult to specify the localization position accurately and intuitively on the user interface.

The present technology has been made in view of such circumstances and enables easy determination of the localization position of a sound image.

Solutions to Problems

A signal processing apparatus of an aspect of the present technology includes: an acquisition unit configured to acquire information associated with a localization position of a sound image of an audio object in a listening space specified in a state where the listening space viewed from a listening position is displayed; and a generation unit configured to generate a bit stream on the basis of the information associated with the localization position.

A signal processing method or a program of an aspect of the present technology includes the steps of: acquiring information associated with a localization position of a sound image of an audio object in a listening space specified in a state where the listening space viewed from a listening position is displayed; and generating a bit stream on the basis of the information associated with the localization position.

In an aspect of the present technology, information associated with a localization position of a sound image of an audio object in a listening space specified in a state where the listening space viewed from a listening position is displayed is acquired; and a bit stream is generated on the basis of the information associated with the localization position.

Effects of the Invention

According to an aspect of the present technology, it is possible to easily determine the localization position of a sound image.

Note that effects described herein are not necessarily limited, but may also be any of those described in the present disclosure.

BRIEF DESCRIPTION OF DRAWINGS

FIG. 5 is a diagram illustrating an example of setting parameters.

MODE FOR CARRYING OUT THE INVENTION

An embodiment to which the present technology has been applied is described below with reference to the drawings.

First Embodiment

<Regarding the Present Technology>

The present technology specifies a localization position of a sound image on a graphical user interface (GUI) that simulates a listening space in which content is reproduced by a point of view shot (hereinafter simply referred to as POV) from a listening position so as to enable easy determination of the localization position of the sound image.

Thus, for example, in a creation tool for audio content, it is possible to achieve a user interface that enables easy determination of the sound localization position. In particular, in the case of object-based audio, a user interface that can easily determine position information of an audio object can be achieved.

First, a case will be described in which the content is a video including a still image or a moving image, and left and right two-channel sound accompanying the video.

In this case, for example, in content creation, the localization of the sound in accordance with the video can be easily determined using a visual and intuitive user interface.

Here, as a specific example, it is assumed that there are audio data of content, i.e., audio data tracks of a total of four musical instruments of a drum, an electric guitar, and two acoustic guitars as audio tracks. Furthermore, it is assumed that there are videos of content including those musical instruments and a musical instrument performer as a subject.

Moreover, it is assumed that the left channel speaker is in the direction where the horizontal angle is 30 degrees when viewed from the listening position of the sound of the content by the listener, and the right channel speaker is in the direction where the horizontal angle is −30 degrees when viewed from the listening position.

Note that the horizontal angle as used herein refers to an angle indicating a position in a horizontal direction, that is, in the left-right direction as viewed from a listener at a listening position. For example, a horizontal angle indicating a position in a direction directly in front of the listener in the horizontal direction is 0 degrees. Furthermore, it is assumed that the horizontal angle indicating the position in the left direction as viewed from the listener is a positive angle, and the horizontal angle indicating the position in the right direction as viewed from the listener is a negative angle.

Now, the determination of the localization position of the sound image of the sound of content for output of the left and right channels is considered.

Figure 1:
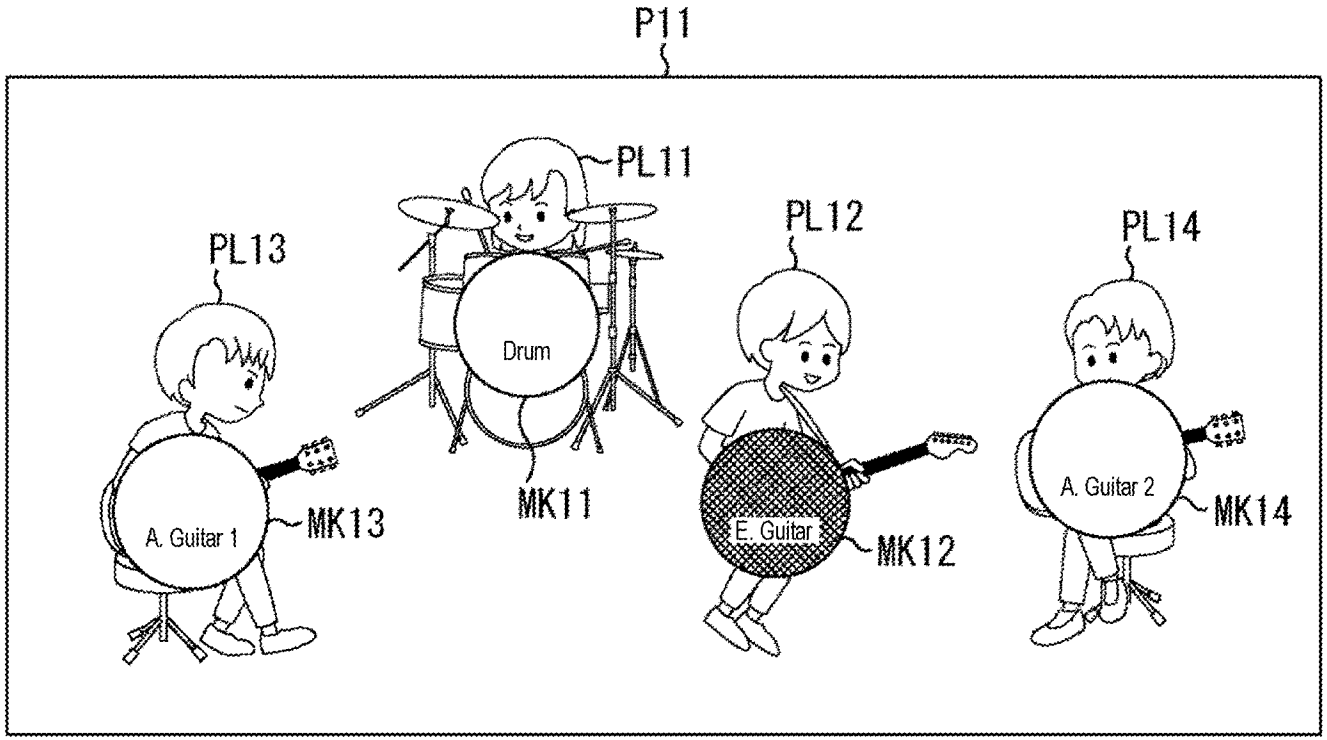
FIG. 1 is a diagram explaining determination of an edited image and a sound image localization position.

In such a case, in the present technology, for example, an edited image P11 illustrated in FIG. 1 is displayed on the display screen of the content creation tool.

The edited image P11 is an image (video) that the listener views while listening to the sound of the content, and, for example, an image including the video of the content is displayed as the edited image P11.

In this example, the performer of the musical instrument is displayed as a subject on the video of the content in the edited image P11.

That is, here, the edited image P11 shows a drum performer PL11, an electric guitar performer PL12, a first acoustic guitar performer PL13, and a second acoustic guitar performer PL14.

Furthermore, the edited image P11 also displays musical instruments such as drums, electric guitars, and acoustic guitars used for the performances of performers PL11 to PL14. These musical instruments can be said to be audio objects that are sound sources of sounds based on audio tracks.

Note that, in the following, when two acoustic guitars are distinguished from each other, the one used by the performer PL13 is also referred to as an acoustic guitar 1, and the one used by the performer PL14 is also referred to as an acoustic guitar 2.

Such an edited image P11 also functions as a user interface, that is, an input interface. On the edited image P11, localization position marks MK11 to MK14 for specifying the localization position of the sound image of the sound of each audio track are also displayed.

Here, the localization position marks MK11 to MK14 indicate the sound image localization positions of the sounds of the audio tracks of the drum, the electric guitar, the acoustic guitar 1, and the acoustic guitar 2, respectively.

In particular, the localization position mark MK12 of the audio track of the electric guitar that is selected as the localization position adjustment target is highlighted, and is displayed in a display format different from that of the localization position mark of the audio track that is not selected.

The content creator moves the localization position mark MK12 of the selected audio track to an arbitrary position on the edited image P11 so that the sound image of the sound of the audio track can be localized at the position of the localization position mark MK12. In other words, an arbitrary position on the video of the content, that is, on the listening space can be specified as the localization position of the sound image of the sound of the audio track.

In this example, the localization position marks MK11 to MK14 of the sounds of the audio tracks corresponding to the musical instruments are arranged at the positions of the musical instruments of the performers PL11 to PL14, and the sound image of the sound of each musical instrument is localized at the position of the musical instrument of the performer.

In the content creation tool, when the localization position of the sound of each audio track is specified by specifying the display position of the localization position mark, the gain value of left and right each channel regarding the audio track (audio data) is calculated on the basis of the display position of the localization position mark.

That is, the proportion ratio to the left and right channels of the audio track is determined on the basis of the coordinates indicating the position of the localization position mark on the edited image P11, and the gain value of each of the left and right channels is obtained from the determination result. Note that, here, since the distribution is performed on the left and right two channels, only the left-right direction (horizontal direction) on the edited image P11 is considered, and the position of the localization position mark in an up-down direction is not considered.

Figure 2:
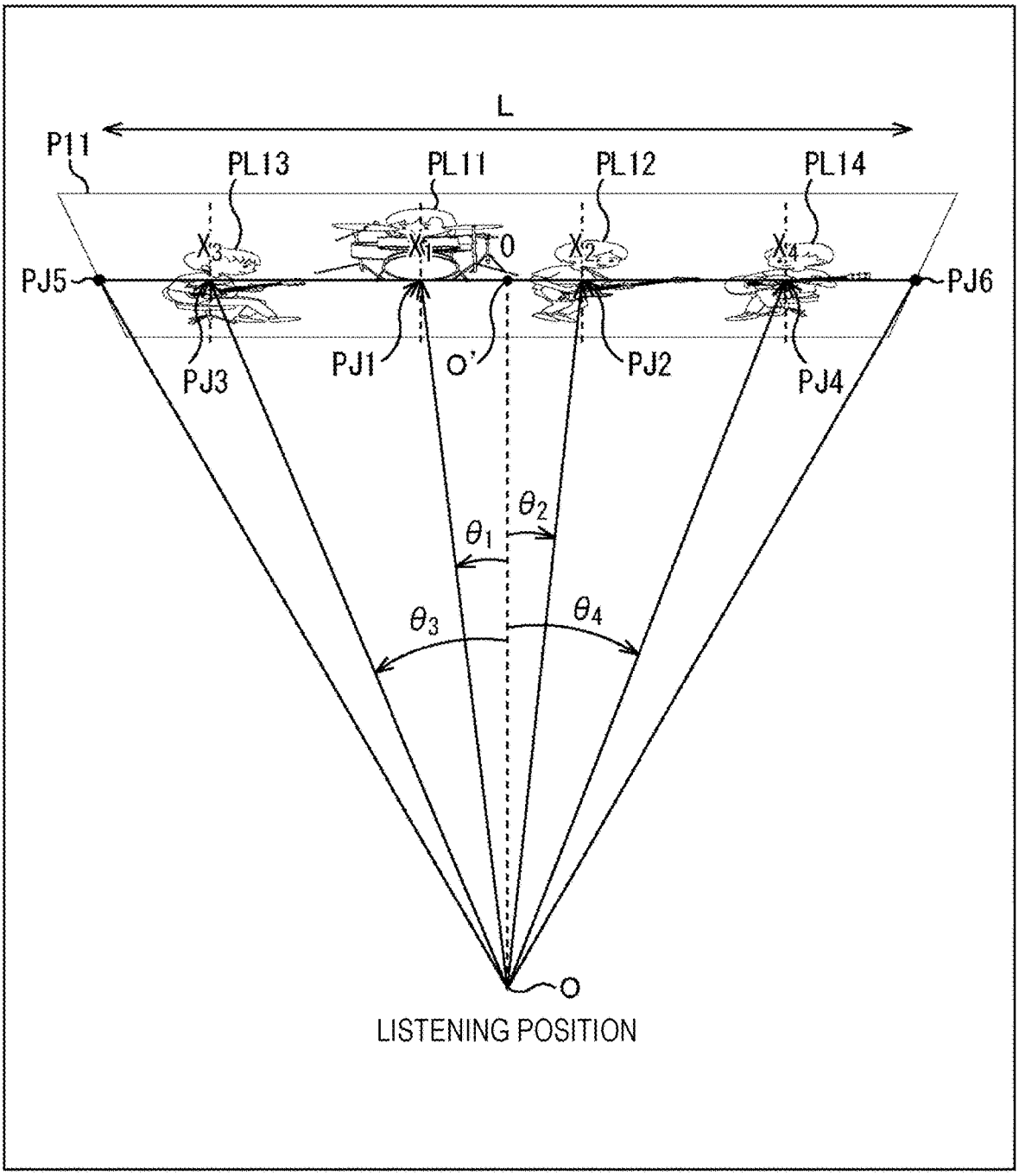
FIG. 2 is a diagram explaining calculation of a gain value.

Specifically, for example, a gain value is obtained on the basis of a horizontal angle indicating the position of each localization position mark in the horizontal direction viewed from the listening position as illustrated in FIG. 2. Note that portions in FIG. 2 corresponding to those of FIG. 1 are designated by the same reference numerals, and description is omitted as appropriate. Furthermore, in FIG. 2, illustration of the localization position mark is omitted for the sake of easy viewing of the drawing.

In this example, the position in front of a listening position O is the edited image P11, i.e., a center position O' of a screen on which the edited image P11 is displayed, and the length of the screen in the left-right direction, that is, a video width of the edited image P11 in the left-right direction is L.

Furthermore, the positions of the performers PL11 to PL14 on the edited image P11, that is, the positions of the musical instruments used for the performances of the performers are positions PJ1 to PJ4. In particular, in this example, since the localization position marks are arranged at the positions of the musical instruments of the respective performers, the positions of the localization position marks MK11 to MK14 are the positions PJ1 to PJ4.

Further, the position of the left end in the figure on the screen where the edited image P11 is displayed is a position PJ5, and the position of the right end in the figure on the screen is a position PJ6. These positions PJ5 and PJ6 are also positions where left and right speakers are arranged.

Now, in the drawing, it is assumed that the coordinates indicating each position of the positions PJ1 to PJ4 viewed from the center position O' in the left-right direction are $X_1$ to $X_4$. In particular, here, it is assumed that the direction of the position PJ5 as viewed from the center position O' is a positive direction, and the direction of the position PJ6 as viewed from the center position O' is a negative direction.

Therefore, for example, the distance from the center position O' to the position PJ1 is the coordinate $X_1$ indicating the position PJ1.

Furthermore, it is assumed that the horizontal directions of the positions PJ1 to PJ4 viewed from the listening position O, that is, the angles indicating the positions in the left-right direction in the drawing are horizontal angles $\theta_1$ to $\theta_4$.

For example, the horizontal angle $\theta_1$ is an angle between a straight line connecting the listening position O and the center position O' and a straight line connecting the listening position O and the position PJ1. In particular, here, the left direction is the direction of the positive angle of the horizontal angle when viewed from the listening position O in the drawing, and the right direction is the direction of the negative angle of the horizontal direction when viewed from the listening position O in the drawing.

Furthermore, as described above, the horizontal angle indicating the position of the left channel speaker is 30 degrees, and the horizontal angle indicating the position of the right channel speaker is −30 degrees. Therefore, the horizontal angle of the position PJ5 is 30 degrees, and the horizontal angle of position PJ6 is −30 degrees.

Since the left and right channel speakers are arranged at the left and right ends of the screen, the viewing angle of the edited image P11, that is, the viewing angle of the content video is also ±30 degrees.

In such a case, the proportion ratio of each audio track (audio data), that is, the gain value of each of the left and right channels is determined by the horizontal angle of the localization position of the sound image when viewed from the listening position O.

For example, the horizontal angle $\theta_1$ indicating the position PJ1 of the audio track of the drum can be obtained from the coordinates $X_1$ indicating the position PJ1 viewed from the center position O' and the video width L by the calculation represented by the following formula (1).

[Math. 1]

$$\theta_1 = \sin^{-1}\frac{2X_1}{L\sqrt{3}} \tag{1}$$

Therefore, gain values $GainL_1$ and $GainR_1$ of the left and right channels for localizing the sound image of the sound based on the audio data (audio track) of the drum at the position PJ1 indicated by the horizontal angle $\theta_1$ can be obtained by the following formulae (2) and (3). Note that the gain value $GainL_1$ is the gain value of the left channel, and the gain value $GainR_1$ is the gain value of the right channel.

[Math. 2]

$$GainL_1 = \sin\left(\frac{3(\theta_1 + 30)}{2}\right) \tag{2}$$

[Math. 3]

$$GainR_1 = \cos\left(\frac{3(\theta_1 + 30)}{2}\right) \tag{3}$$

At the time of content reproduction, the audio data of the drum is multiplied by the gain value $GainL_1$, and a sound is output from the left channel speaker on the basis of the resultant audio data. Furthermore, the gain value $GainR_1$ is multiplied by the audio data of the drum, and a sound is output from the right channel speaker on the basis of the resultant audio data.

Then, the sound image of the sound of the drum is localized at the position PJ1, that is, the position of the drum (the performer PL11) in the video of the content.

Calculation similar to Formulae (1) to (3) is performed not only for the audio track of the drum, but also for that of the others: the electric guitar, the acoustic guitar 1, and the acoustic guitar 2, to calculate the gain value of each of the left and right channels.

That is, on the basis of the coordinates $X_2$ and the video width L, gain values $GainL_2$ and $GainR_2$ of the left and right channels of the audio data of the electric guitar are obtained.

Furthermore, on the basis of the coordinates $X_3$ and the video width L, gain values $GainL_3$ and $GainR_3$ of the left and right channels of the audio data of the acoustic guitar 1 are obtained, and on the basis of the coordinates $X_4$ and the video width L, gain values $GainL_4$ and $GainR_4$ of the left and right channels of the audio data of the acoustic guitar 2 are obtained.

Note that in a case where it is assumed that the speakers of the left and right channels are located outside the end of the screen, that is, in a case where a distance $L_{spk}$ between the left and right speakers is larger than the video width L, it is sufficient if calculation is performed by replacing the video width L with the distance $L_{spk}$ in Formula (1).

In the manner described above, in the creation of left and right two-channel content, the sound image localization position of the sound that matches the video of the content can be easily determined using an intuitive user interface.

(Configuration Example of the Signal Processing Apparatus)

Next, a signal processing apparatus to which the present technology described above is applied will be described.

Figure 3:
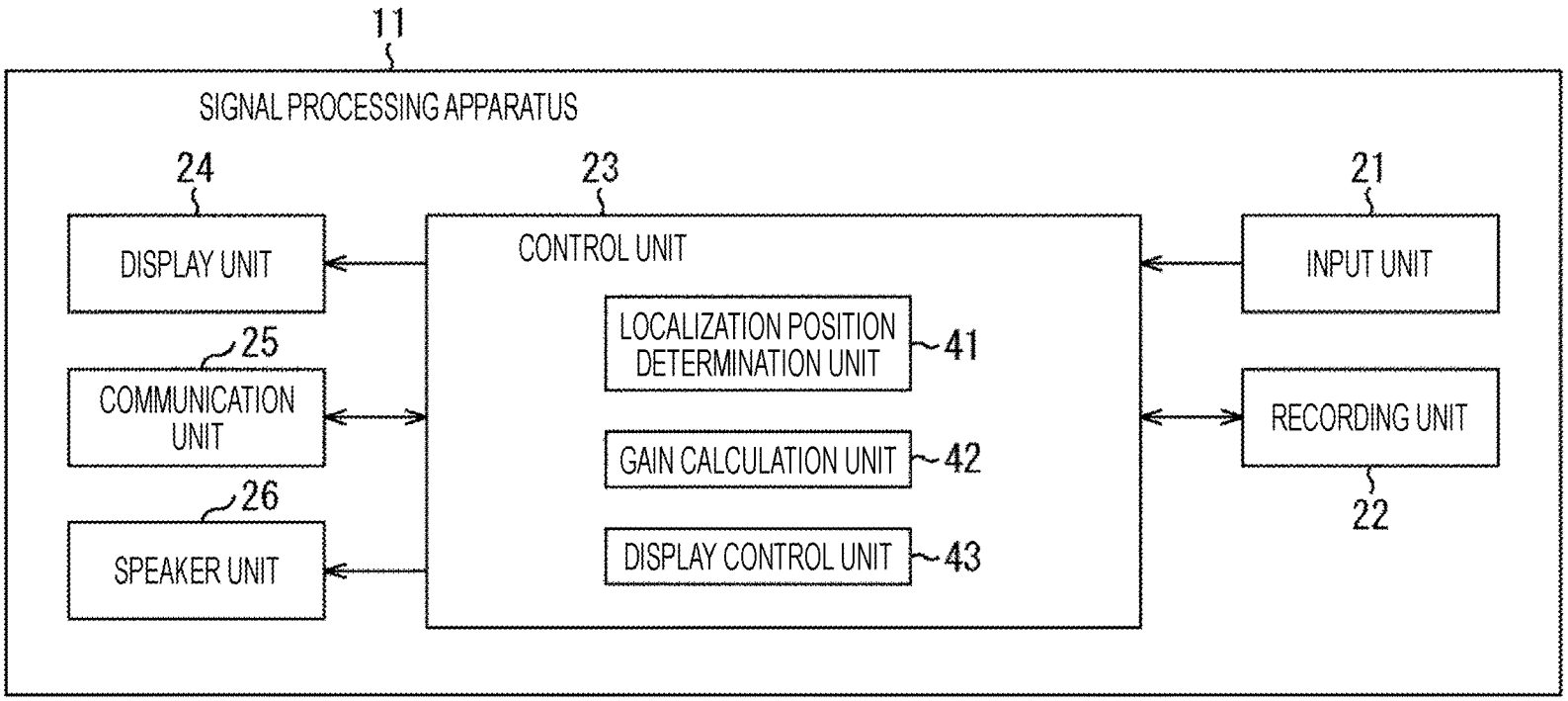
FIG. 3 is a diagram illustrating a configuration example of a signal processing apparatus.

FIG. 3 is a diagram illustrating a configuration example of an embodiment of a signal processing apparatus to which the present technology has been applied.

A signal processing apparatus 11 illustrated in FIG. 3 includes an input unit 21, a recording unit 22, a control unit 23, a display unit 24, a communication unit 25, and a speaker unit 26.

The input unit 21 includes a switch, a button, a mouse, a keyboard, a touch panel superimposed on the display unit 24, and the like, and supplies a signal corresponding to an input operation of a user who is a content creator to the control unit 23.

The recording unit 22 includes, for example, a non-volatile memory such as a hard disk, and records the audio data and the like supplied from the control unit 23 and supplies the recorded data to the control unit 23. Note that the recording unit 22 may be a removable recording medium that is detachable from the signal processing apparatus 11.

The control unit 23 controls the operation of the entire signal processing apparatus 11. The control unit 23 includes a localization position determination unit 41, a gain calculation unit 42, and a display control unit 43.

The localization position determination unit 41 determines the localization position of each audio track, that is, the sound image of the sound of each audio data, on the basis of the signal supplied from the input unit 21.

In other words, the localization position determination unit 41 can be said to be capable of functioning as an acquisition unit that acquires information associated with the localization position of the sound image of the sound of the audio object such as a musical instrument viewed from the listening position in the listening space displayed on the display unit 24, and determines the localization position.

Here, the information associated with the localization position of the sound image is, for example, position information indicating the localization position of the sound image of the sound of the audio object viewed from the listening position, information for obtaining the position information, or the like.

The gain calculation unit 42 calculates a gain value of each channel for audio data with respect to each audio object, i.e., audio track, on the basis of the localization position determined by the localization position determination unit 41. The display control unit 43 controls the display unit 24 to control the display of images and the like on the display unit 24.

Furthermore, the control unit 23 also functions as a generation unit that generates and outputs an output bit stream including at least the audio data of the content on the basis of the information associated with the localization position acquired by the localization position determination unit 41 and the gain value calculated by the gain calculation unit 42.

The display unit 24 includes, for example, a liquid crystal display panel, and displays various images or the like such as a POV image under the control of the display control unit 43.

The communication unit 25 communicates with an external apparatus via a wired or wireless communication network such as the Internet. For example, the communication unit 25 receives data transmitted from the external apparatus and supplies the data to the control unit 23, or transmits the data supplied from the control unit 23 to the external apparatus.

The speaker unit 26 includes, for example, a speaker of each channel of a speaker system having a predetermined channel configuration, and reproduces (outputs) the sound of the content on the basis of the audio data supplied from the control unit 23.

<Description of the Localization Position Determination Processing>

Next, the operation of the signal processing apparatus 11 will be described.

That is, the localization position determination processing performed by the signal processing apparatus 11 will be described below with reference to the flowchart of FIG. 4.

In step S11, the display control unit 43 causes the display unit 24 to display an edited image.

For example, when a signal giving an instruction on activation of a content creation tool is supplied from the input unit 21 to the control unit 23 in response to an operation by a content creator, the control unit 23 activates the content creation tool. At this time, the control unit 23 reads out the image data of the video of the content specified by the content creator and the audio data attached to the video from the recording unit 22 as necessary.

Then, the display control unit 43 supplies image data for displaying the display screen (window) of the content creation tool including the edited image to the display unit 24 according to the activation of the content creation tool, and causes the display screen to be displayed. Here, the edited image is, for example, an image in which a localization position mark indicating a sound image localization position of a sound based on each audio track is superimposed on a video of content.

The display unit 24 causes a display screen of the content creation tool to be displayed on the basis of the image data supplied from the display control unit 43. Thus, for example, a screen including the edited image P11 illustrated in FIG. 1 is displayed on the display unit 24 as a display screen of the content creation tool.

When the display screen of the content creation tool including the edited image is displayed, the content creator operates the input unit 21 to select the audio track to be adjusted in localization position of the sound image from the audio tracks (audio data) of the content. Then, a signal corresponding to the selection operation by the content creator is supplied from the input unit 21 to the control unit 23.

The selection of the audio track may be performed by, for example, specifying a desired audio track at a desired reproduction time, for example, on a timeline of the audio track displayed separately from the edited image on the display screen or by directly specifying the displayed localization position mark.

In step S12, the localization position determination unit 41 selects an audio track for which the localization position of the sound image is adjusted on the basis of the signal supplied from the input unit 21.

When the audio track for which the localization position of the sound image is to be adjusted is selected by the localization position determination unit 41, the display control unit 43 causes the display unit 24, according to the selection result, to display the localization position mark corresponding to the selected audio track to be displayed in a display format different from those of other localization position marks.

When the localization position mark corresponding to the selected audio track is displayed in a display format different from those of other localization position marks, the content creator operates the input unit 21 to move the target localization position mark to an arbitrary position so as to specify the localization position of the sound image.

For example, in the example illustrated in FIG. 1, the content creator specifies the sound image localization position of the electric guitar sound by moving the position of the localization position mark MK12 to an arbitrary position.

Then, since a signal corresponding to the input operation by the content creator is supplied from the input unit 21 to the control unit 23, the display control unit 43 causes the display unit 24, according to the signal supplied from the input unit 21, to move the display position of the localization position mark.

Furthermore, in step S13, the localization position determination unit 41 determines the localization position of the sound image of the sound of the audio track to be adjusted on the basis of the signal supplied from the input unit 21.

That is, the localization position determination unit 41 acquires, from the input unit 21, information (signal) indicating the position of the localization position mark in the edited image, which is output in response to the input operation by the content creator. Then, the localization position determination unit 41 determines the position indicated by the target localization position mark on the edited image, that is, on the video of the content, as the localization position of the sound image, on the basis of the acquired information.

Furthermore, in accordance with the determination of the localization position of the sound image, the localization position determination unit 41 generates position information indicating the localization position.

For example, in the example illustrated in FIG. 2, it is assumed that the localization position mark MK12 has been moved to the position PJ2. In such a case, the localization position determination unit 41 performs the calculation similar to the above-described Formula (1) on the basis of the acquired coordinates $X_2$, and calculates the horizontal angle $\theta_2$ as the position information indicating the localization position of the sound image for the audio track of the electric guitar, in other words, the position information indicating the position of the performer PL12 (electric guitar) as an audio object.

In step S14, the gain calculation unit 42 calculates the gain values of the left and right channels for the audio track selected in step S12 on the basis of the horizontal angle as the position information obtained as a result of determining the localization position in step S13.

For example, in step S14, calculation similar to the above-described Formulae (2) and (3) is performed to calculate the gain values of the left and right channels.

In step S15, the control unit 23 determines whether or not to end the adjustment of the localization position of the sound image. For example, in a case where the content creator operates the input unit 21 to give an instruction on the end of the output the content, that is, the content creation, it is determined in step S15 that the adjustment of the localization position of the sound image is to be ended.

In a case where it is determined in step S15 that the adjustment of the localization position of the sound image is not yet to be ended, the processing returns to step S12, and the above-described processing is repeated. That is, the localization position of the sound image is adjusted for the newly selected audio track.

On the other hand, in a case where it is determined in step S15 that the adjustment of the localization position of the sound image is to be ended, the processing proceeds to step S16.

In step S16, the control unit 23 outputs an output bit stream based on the position information of each object, in other words, an output bit stream based on the gain value obtained in the processing in step S14, and the localization position determination processing ends.

For example, in step S16, the control unit 23 multiplies the audio data by the gain value obtained in the processing in step S14 to generate left and right channel audio data for each audio track of the content. Furthermore, the control unit 23 adds the obtained audio data of the same channel to obtain final audio data of each of the left and right channels, and outputs an output bit stream including the resultant audio data. Here, the output bit stream may include image data of the video of the content.

Furthermore, the output destination of the output bit stream can be an arbitrary output destination such as the recording unit 22, the speaker unit 26, or an external apparatus.

For example, an output bit stream including the audio data and image data of the content may be supplied to and recorded on the recording unit 22, a removable recording medium, or the like, or audio data as an output bit stream may be supplied to the speaker unit 26 and the sound of the content may be reproduced. Furthermore, for example, an output bit stream including audio data and image data of content may be supplied to the communication unit 25, and the output bit stream may be transmitted to an external apparatus by the communication unit 25.

At this time, for example, the audio data and the image data of the content included in the output bit stream may or may not have been encoded by a predetermined encoding method. Moreover, an output bit stream including, for example, each audio track (audio data), the gain value obtained in step S14, and the image data of the video of the content may of course be generated.

As described above, the signal processing apparatus 11 displays the edited image, moves the localization position mark according to the operation of the user (content creator), and determines the localization position of the sound image on the basis of the position indicated by the localization position mark, that is, the display position of the localization position mark.

In this way, the content creator can easily determine (specify) an appropriate localization position of the sound image simply by performing an operation of moving the localization position mark to a desired position while viewing the edited image.

Second Embodiment

<POV Image Display>

Incidentally, in the first embodiment, an example has been described in which the audio (sound) of the content is output of the left and right two channels. However, the present technology is not limited to this, and is also applicable to object-based audio in which a sound image is localized at an arbitrary position in a three-dimensional space.

Hereinafter, a case will be described in which the present technology has been applied to object-based audio that targets sound image localization in a three-dimensional space (hereinafter, simply referred to as object-based audio).

Here, it is assumed that the sound of the content includes the sound of the audio object, and the audio objects include a drum, an electric guitar, the acoustic guitar 1, and the acoustic guitar 2 similarly to the above-described example. Furthermore, it is assumed that the content includes audio data of each audio object and image data of a video corresponding to the audio data. Note that the video of the content may be a still image or a moving image.

With object-based audio, the sound image can be localized in any direction in the three-dimensional space. Therefore, it is assumed that the sound image is localized at a position outside a range where the video is present even in a case where the video is involved, that is, at a position that cannot be seen in the video. In other words, because of the high degree of freedom in localizing the sound image, it is difficult to accurately determine the localization position of the sound image in accordance with the video, and after knowing where the video is in the three-dimensional space, it is needed to specify the localization position of the sound image.

Therefore, according to the present technology, for the content of the object-based audio, first, a content reproduction environment is set in the content creation tool.

Here, the reproduction environment is, for example, a three-dimensional space such as a room where the content is reproduced, which is assumed by the content creator, that is, a listening space. When setting the reproduction environment, the size of the room (listening space), the listening position, which is the position of a viewer/listener who views/listens to the content, that is, the listener of the sound of the content, the shape of the screen on which the video of the content is displayed, the arrangement position of the screen, and the like are specified by parameters.

For example, the parameters illustrated in FIG. 5 are specified by the content creator as parameters (hereinafter, also referred to as setting parameters) for specifying the reproduction environment, which are specified when setting the reproduction environment.

In the example illustrated in FIG. 5, "depth", "width", and "height" that determine the size of the room that is the listening space are indicated as setting parameters, and here, the depth of the room is "6.0 m", the width of the room is "8.0 m", and the height of the room is "3.0 m".

Furthermore, "listening position" which is the position of the listener in the room (listening space) is indicated as a setting parameter, and the listening position is set to the "center of the room".

Moreover, the "size" and "aspect ratio" that determine the shape of the screen (display apparatus) on which the video of the content is displayed, i.e., the shape of the display screen in the room (listening space) are illustrated as setting parameters.

The setting parameter "size" indicates the size of the screen, and "aspect ratio" indicates the aspect ratio of the screen (display screen). Here, the size of the screen is "120 inches", and the aspect ratio of the screen is "16:9".

In addition, FIG. 5 illustrates "front and back", "left and right", and "up and down" that determine the position of the screen as setting parameters related to the screen.

Here, the setting parameter "front and back" is the distance in the front-back direction from the listener to the screen when the listener at the listening position in the listening space (room) looks at a reference direction, and, in this example, the value of the setting parameter "front and back" is "2 m in front of the listening position". That is, the screen is arranged 2 m in front of the listener.

Furthermore, the setting parameter "left and right" is the position in the left-right direction of the screen viewed from the listener facing the reference direction at the listening position in the listening space (room), and, in this example, the setting (value) of the setting parameter "left and right" is "center". That is, the screen is arranged such that the position of the center of the screen in the left-right direction is directly in front of the listener.

The setting parameter "up and down" is the position of the screen in the up-down direction viewed from the listener facing the reference direction at the listening position in the listening space (room), and, in this example, the setting (value) of the setting parameter "up and down" is "the center of the screen is the height of the listener's ear". That is, the screen is arranged such that the position of the center of the screen in the up-down direction is the position of the height of the listener's ear.

In the content creation tool, a POV image or the like is displayed on the display screen in accordance with the setting parameters described above. That is, on the display screen, a POV image simulating the listening space by the setting parameters is displayed in a 3D graphic.

Figure 6:
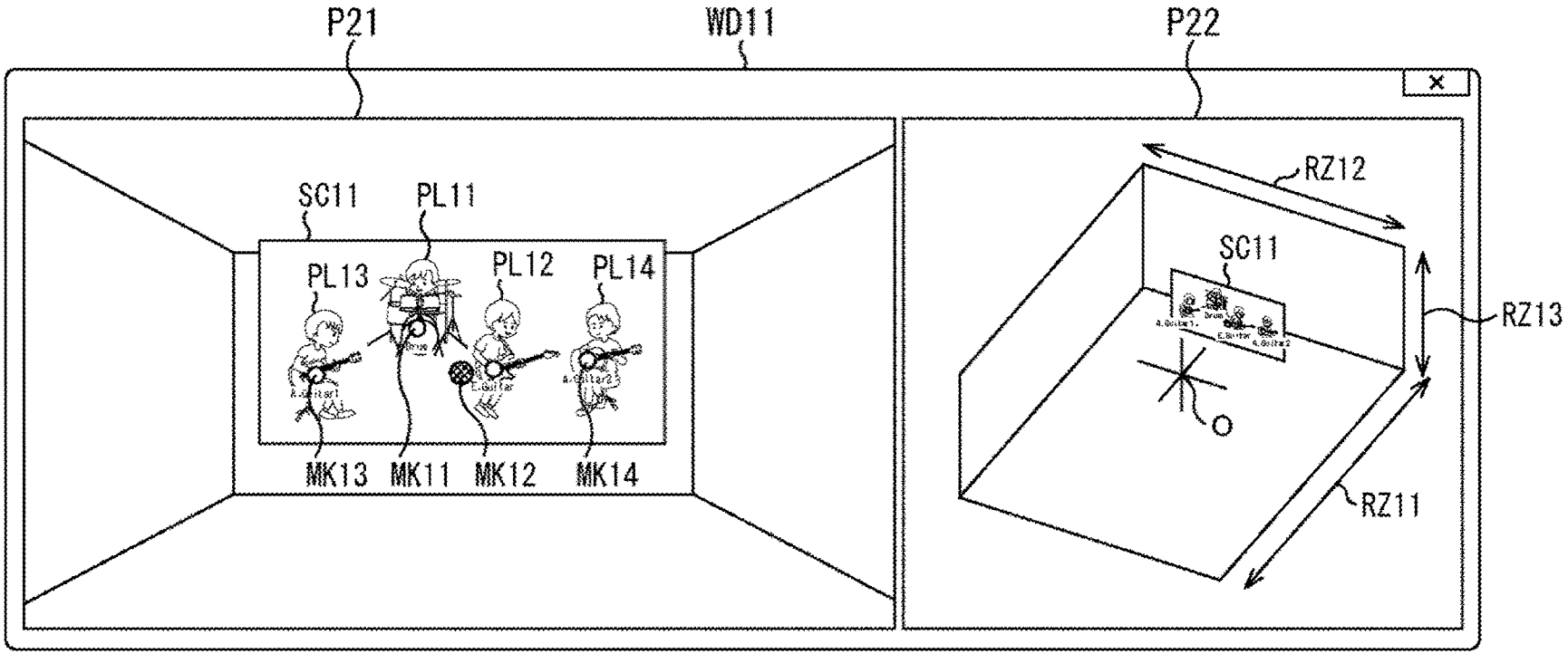
FIG. 6 is a diagram illustrating a display example of a POV image and an overhead image.

For example, in a case where the setting parameters illustrated in FIG. 5 are specified, the screen illustrated in FIG. 6 is displayed as the display screen of the content creation tool. Note that portions in FIG. 6 corresponding to those of FIG. 1 are designated by the same reference numerals, and description is omitted as appropriate.

In FIG. 6, a window WD11 is displayed as a display screen of the content creation tool. In this window WD11, a POV image P21 which is an image of the listening space viewed from the listener's viewpoint and an overhead image P22, which is an image obtained when the listening space is viewed from a bird's eye, are displayed.

In the POV image P21, a wall or the like of a room, which is a listening space, viewed from the listening position is displayed, and a screen SC11 on which a video of the content is superimposed is arranged at a position in front of the listener in the room. In the POV image P21, the listening space viewed from the actual listening position is reproduced almost as it is.

In particular, the screen SC11 is a screen having an aspect ratio of 16:9 and a size of 120 inches as specified by the setting parameters of FIG. 5. Furthermore, the screen SC11 is arranged at a position in the listening space determined by the setting parameters "front and back", "left and right", and "up and down" illustrated in FIG. 5.

On the screen SC11, the performers PL11 to PL14, which are subjects in the video of the content, are displayed.

Furthermore, the POV image P21 also displays the localization position marks MK11 to MK14. In this example, these localization position marks are positioned on the screen SC11.

Note that, in FIG. 6, an example is illustrated in which the POV image P21 is displayed in a case where the line-of-sight direction of the listener is a predetermined reference direction, that is, the front direction of the listening space (hereinafter, also referred to as the reference direction). However, the content creator can change the line-of-sight direction of the listener to an arbitrary direction by operating the input unit 21. When the line-of-sight direction of the listener is changed, an image of the listening space in the changed line of sight direction is displayed as a POV image in the window WD11.

Furthermore, more specifically, the viewpoint position of the POV image can be set not only at the listening position but also at a position near the listening position. For example, in a case where the viewpoint position of the POV image is set to a position near the listening position, the listening position is always displayed in front of the POV image.

Therefore, even in a case where the viewpoint position is different from the listening position, the content creator viewing the POV image can easily grasp which position the displayed POV image has as the viewpoint position.

On the other hand, the overhead image P22 is an image of the entire room that is the listening space, that is, an image of the listening space viewed from a bird's eye.

In particular, in the drawing of the listening space, the length in the direction indicated by arrow RZ11 is the length of the depth of the listening space indicated by the setting parameter "depth" illustrated in FIG. 5. Similarly, the length of the listening space in the direction indicated by arrow RZ12 is the length of the width of the listening space indicated by the setting parameter "width" illustrated in FIG. 5, and the length of the listening space in the direction indicated by the RZ13 is the height of the listening space indicated by the setting parameter "height" illustrated in FIG. 5.

Moreover, point O displayed on the overhead image P22 indicates the position indicated by the setting parameter "listening position" illustrated in FIG. 5, that is, the listening position. Hereinafter, the point O is particularly also referred to as listening position O.

As described above, by displaying the image of the entire listening space in which the listening position O, the screen SC11, and the localization position marks MK11 to MK14 are displayed as the overhead image P22, the content creator can appropriately grasp the positional relationship between the listening position O, the screen SC11, the performers, and the musical instruments (audio objects).

The content creator operates the input unit 21 while viewing the POV image P21 and the overhead image P22 displayed in this manner, and moves the localization position marks MK11 to MK14 regarding the respective audio tracks to desired positions, thereby specifying the localization position of the sound image.

In this way, similarly to the case of FIG. 1, the content creator can easily determine (specify) an appropriate localization position of the sound image.

The POV image P21 and the overhead image P22 illustrated in FIG. 6 also function as an input interface similarly to the case of the edited image P11 illustrated in FIG. 1, and by specifying an arbitrary position of the POV image P21 or the overhead image P22, the sound image localization position of the sound of each audio track can be specified.

For example, when the content creator operates the input unit 21 or the like to specify a desired position on the POV image P21, a localization position mark is displayed at that position.

In the example illustrated in FIG. 6, similarly to the case of FIG. 1, the localization position marks MK11 to MK14 are displayed at positions on the screen SC11, that is, at positions on the video of the content. Therefore, it is understood that the sound image of the sound of each audio track is localized at the position of each subject (audio object) of the video corresponding to the sound. In other words, it can be seen that sound image localization in accordance with the video of the content is achieved.

Note that, in the signal processing apparatus 11, for example, the position of the localization position mark is managed by coordinates of a coordinate system having the listening position O as the origin (reference).

For example, in a case where the coordinate system with the listening position O as the origin is a polar coordinate, the position of the localization position mark is represented by the horizontal angle indicating the position in the horizontal direction, i.e., the left-right direction, viewed from the listening position O, the vertical angle indicating the position in the vertical direction, i.e., the up-down direction viewed from the listening position O, and the radius indicating the distance from the listening position O to the localization position mark.

Note that, a description is continuously given below on the assumption that the position of the localization position mark is represented by a horizontal angle, a vertical angle, and a radius, that is, by a polar coordinate, but the position of the localization position mark may be represented by coordinates of a three-dimensional rectangular coordinate system or the like with the listening position O as the origin.

In a case where the localization position mark is represented by a polar coordinate in this way, the adjustment of the display position of the localization position mark in the listening space can be performed, for example, in the manner described below.

That is, when the content creator operates the input unit 21 or the like to specify a desired position on the POV image P21 by clicking or the like, a localization position mark is displayed at that position. Specifically, for example, a localization position mark is displayed at a position specified by the content creator on a spherical surface having radius 1 around the listening position O.

Figure 7:
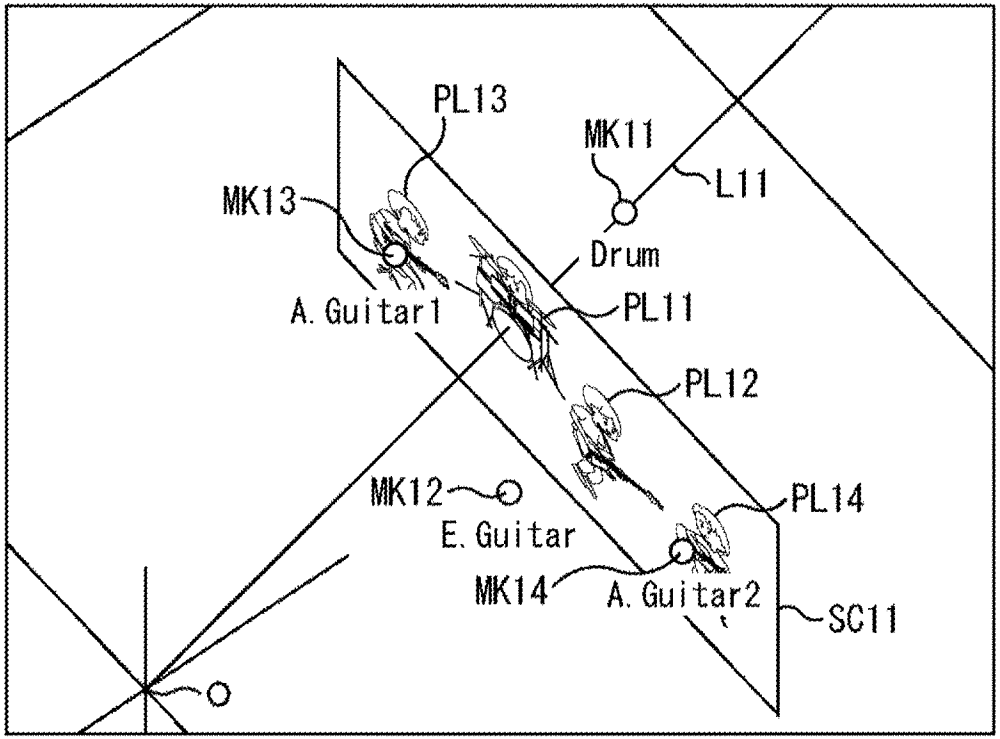
FIG. 7 is a diagram explaining adjustment of the arrangement position of a localization position mark.

Furthermore, at this time, for example, as illustrated in FIG. 7, a straight line L11 extending from the listening position O in the line-of-sight direction of the listener is displayed, and the localization position mark MK11 to be processed is displayed on the straight line L11. Note that portions in FIG. 7 corresponding to those of FIG. 6 are designated by the same reference numerals, and description is omitted as appropriate.

In the example illustrated in FIG. 7, the localization position mark MK11 corresponding to the audio track of the drum is a target to be processed, that is, a target to be adjusted for the localization position of the sound image, and the localization position mark MK11 is displayed on the straight line L11 extending in the line-of-sight direction of the listener.

The content creator can move the localization position mark MK11 to an arbitrary position on the straight line L11 by performing, for example, a wheel operation on the mouse as the input unit 21. In other words, the content creator can adjust the distance from the listening position O to the localization position mark MK11, that is, the radius of the polar coordinates indicating the position of the localization position mark MK11.

Furthermore, the content creator can also adjust the direction of the straight line L11 in an arbitrary direction by operating the input unit 21.

Through such an operation, the content creator can move the localization position mark MK11 to an arbitrary position in the listening space.

Therefore, for example, the content creator can move the position of the localization position mark on a near side or a far side when viewed from the listener relative to the display position of the video of the content, i.e., the position of the screen SC11, which is the position of the subject corresponding to the audio object.

For example, in the example illustrated in FIG. 7, the localization position mark MK11 of the audio track of the drum is located on the far side of the screen SC11 when viewed from the listener, and the localization position mark MK12 of the audio track of the electric guitar is located on the near side of the screen SC11 when viewed from the listener.

Furthermore, the localization position mark MK13 of the audio track of the acoustic guitar 1 and the localization position mark MK14 of the audio track of the acoustic guitar 2 are located on the screen SC11.

As described above, in the content creation tool to which the present technology is applied, for example, with the position of the screen SC11 as a reference, the sound image is localized at an arbitrary position in the depth direction such as the near side or the far side when viewed from the listener from the position, and the sense of distance can be controlled.

For example, in object-based audio, position coordinates of polar coordinate with the listener's position (listening position) as the origin are handled as meta information of the audio object.

In the example described with reference to FIGS. 6 and 7, each audio track is audio data of an audio object, and each localization position mark is the position of the audio object. Therefore, position information indicating the position of the localization position mark can be position information as meta information of the audio object.

Then, when the content is reproduced, if the audio object (audio track) is rendered on the basis of the position information which is the meta information of the audio object, the sound image of the sound of the audio object can be localized at the position indicated by the position information, that is, the position indicated by the localization position mark.

In the rendering, for example, a gain value proportioned to each speaker channel of a speaker system used for reproduction is calculated by the VBAP method on the basis of the position information. That is, the gain value of each channel of the audio data is calculated by the gain calculation unit 42.

Then, the audio data multiplied by each of the calculated gain values of the respective channels becomes the audio data of those channels. Furthermore, in a case where there is a plurality of audio objects, the audio data of the same channel obtained for those audio objects is added to obtain final audio data.

When the speaker outputs a sound on the basis of the audio data of each channel obtained in this way, the sound image of the sound of the audio object is localized at the position indicated by the position information as the meta information, i.e., the localization position mark.

Therefore, especially when the position on the screen SC11 is specified as the position of the localization position mark, the sound image is localized at the position on the video of the content when the actual content is reproduced.

Note that, as the position of the localization position mark as illustrated in FIG. 7, any position such as a position different from the position on the screen SC11 can be specified. Therefore, the radius indicating the distance from the listener to the audio object, which constitutes the position information as the meta information, can be used as information for controlling the sense of distance when the sound of the content is reproduced.

For example, it is assumed that in a case where the content is reproduced in the signal processing apparatus 11, the radius included in the position information as the meta information of the audio data of the drum is a value twice the reference value (for example, 1).

In such a case, for example, if the control unit 23 performs gain adjustment by multiplying the audio data of the drum by the gain value "0.5", the sound of the drum becomes smaller, and it is possible to achieve the sense of distance control such that as if the sound of the drum was heard from a position farther than the position of the reference distance.

Note that, the sense of distance control by the gain adjustment is merely an example of the sense of distance control using the radius included in the position information, and the sense of distance control may be achieved by any other method. By performing such sense of distance control, for example, the sound image of the sound of the audio object can be localized at a desired position such as a near side or a far side of the reproduction screen.

In addition, for example, in the moving picture experts group (MPEG)-H 3D Audio standard, the reproduction screen size on the content creation side can be transmitted to the user side, that is, the content reproduction side as meta information.

In this case, when the position and size of the reproduction screen on the content creation side are different from those on the reproduction screen on the content reproduction side, the position information of the audio object is corrected on the content reproduction side and the sound image of the sound of the audio object can be localized at an appropriate position on the reproduction screen. Therefore, also in the present technology, for example, the setting parameters indicating the position, size, arrangement position, and the like of the screen illustrated in FIG. 5 may be used as the meta information of the audio object.

Moreover, in the description given with reference to FIG. 7, an example has been described in which the position of the localization position mark is the position on the near side or the far side of the screen SC11 present in front of the listener, and the position on the screen SC11. However, the position of the localization position mark is not limited to the position in front of the listener, but may be any position outside the screen SC11, such as a lateral side of, behind, above, or below the listener.

For example, if the position of the localization position mark is set to a position outside the frame of the screen SC11 when viewed from the listener, when the content is actually reproduced, the sound image of the sound of the audio object is localized at the position outside the range where the video of the content exists.

Furthermore, the case has been described as an example where the screen SC11 on which the video of the content is displayed is in the reference direction as viewed from the listening position O. However, the screen SC11 may be arranged not only in the reference direction, but also in any direction, such as backside, above, below, left side, right side, or the like when viewed from the listener who is facing in the reference direction, or a plurality of screens may be arranged in the listening space.

As described above, the line-of-sight direction of the POV image P21 can be changed in an arbitrary direction in the content creation tool. In other words, the listener can look around about the listening position O.

Therefore, the content creator can operate the input unit 21 to specify an arbitrary direction such as a lateral side or a back side when the reference direction is the front direction as the line-of-sight direction of the POV image P21 so as to arrange the localization position mark in any position in each direction.

Figure 8:
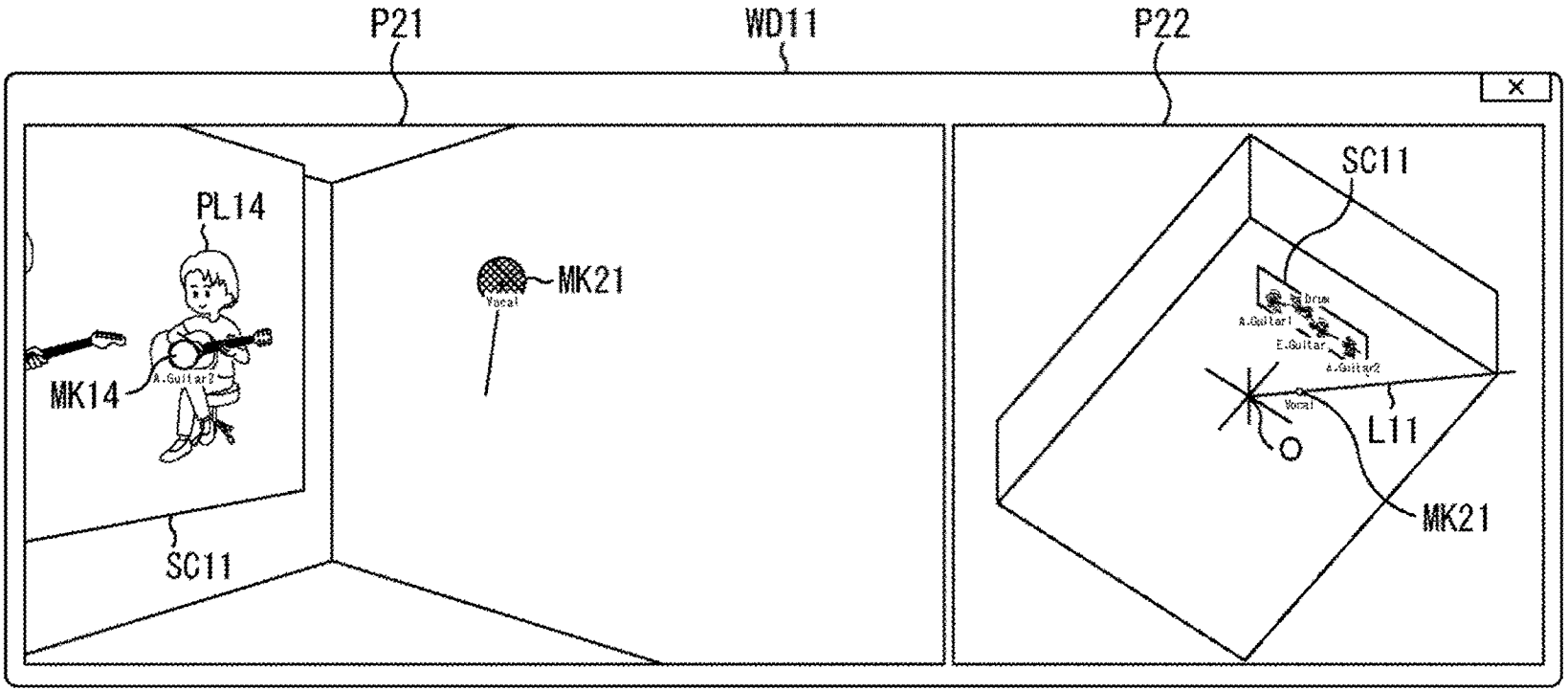
FIG. 8 is a diagram explaining adjustment of the arrangement position of a localization position mark.

Therefore, for example, as illustrated in FIG. 8, it is possible to change the line-of-sight direction of the POV image P21 to a direction outside the right end of the screen SC11, and arrange the localization position mark MK21 of a new audio track in that direction. Note that portions in FIG. 8 corresponding to those of FIG. 6 or 7 are designated by the same reference numerals, and description is omitted as appropriate.

In the example of FIG. 8, vocal audio data as an audio object is added as a new audio track, and a localization position mark MK21 indicating a sound image localization position of a sound based on the added audio track is displayed.

Here, the localization position mark MK21 is arranged at a position outside the screen SC11 when viewed from the listener. Therefore, when the content is reproduced, the listener perceives the vocal sound as being heard from a position that cannot be seen in the video of the content.

Note that in a case where it is assumed that the screen SC11 is arranged at the lateral side or back side position when viewed from the listener who is facing in the reference direction, the screen SC11 is arranged at the lateral side or the back side position, and a POV image in which the video of the content is displayed is displayed on the screen SC11. In this case, if each localization position mark is arranged on the screen SC11, the sound image of the sound of each audio object (musical instrument) will be localized at the video position when the content is reproduced.

As described above, the content creation tool can easily achieve the sound image localization in accordance with the video of the content only by arranging the localization position mark on the screen SC11.

Figure 9:
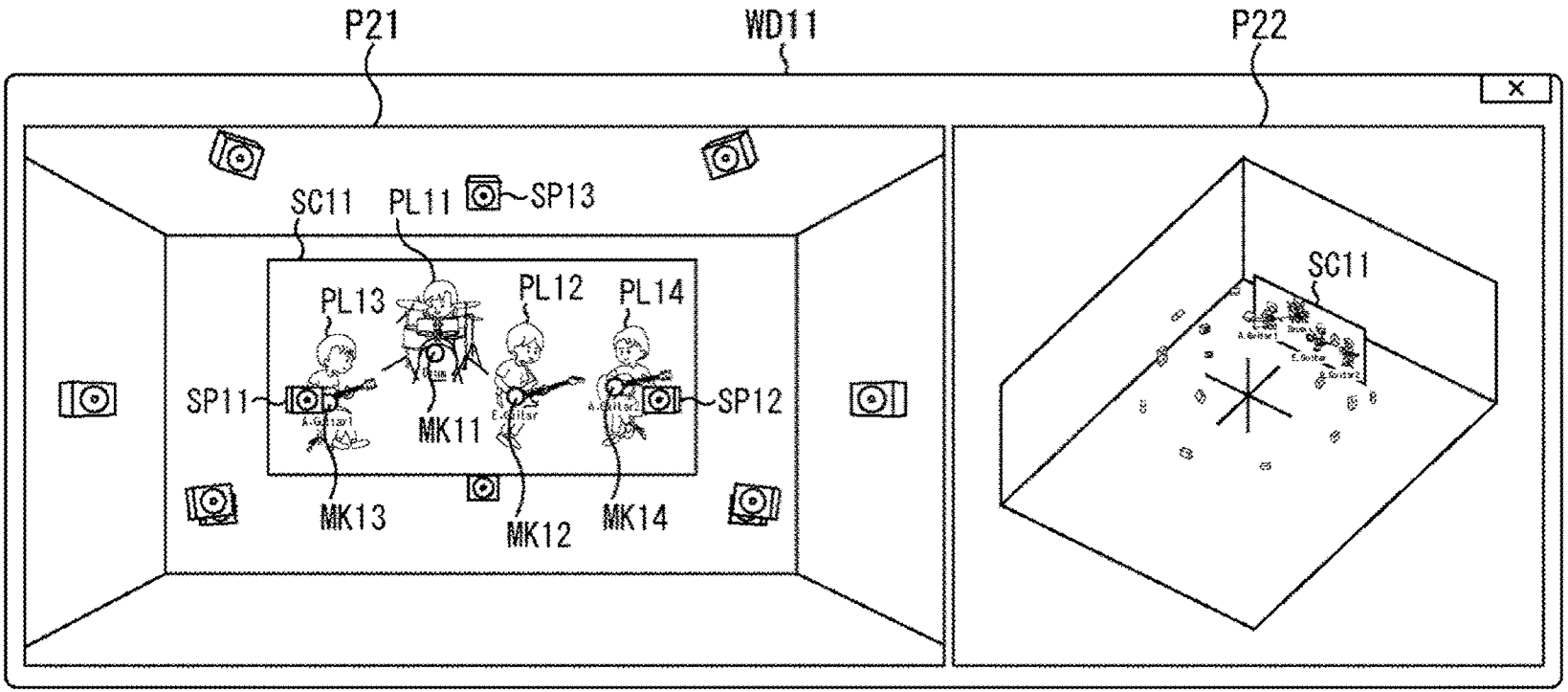
FIG. 9 is a diagram illustrating a display example of a speaker.

Moreover, as illustrated in FIG. 9, a layout display of speakers used for content reproduction may be performed on the POV image P21 or the overhead image P22. Note that portions in FIG. 9 corresponding to those of FIG. 6 are designated by the same reference numerals, and description is omitted as appropriate.

In the example illustrated in FIG. 9, on the POV image P21, a plurality of speakers including a speaker SP11 on the front left side of the listener, a speaker SP12 on the front right side of the listener, and a speaker SP13 on the front upper side of the listener is displayed. Similarly, a plurality of speakers including the speakers SP11 to SP13 is displayed on the overhead image P22.

These speakers are speakers of respective channels constituting a speaker system used at the time of content reproduction, which is assumed by the content creator.

The content creator specifies the channel configuration of the speaker system, such as 7.1 channel or 22.2 channel, by operating the input unit 21 so that each speaker of the speaker system having the specified channel configuration can be displayed on the POV image P21 and the overhead image P22. That is, the speaker layout of the specified channel configuration can be displayed in a superimposed manner in the listening space.

In object-based audio, various speaker layouts can be supported by performing rendering based on the position information of each audio object using the VBAP method.

In the content creation tool, by displaying speakers on the POV image P21 and the overhead image P22, the content creator can visually easily grasp the positional relationship between the speakers, the localization position marks, that is, the audio objects, and the display positions of the video of the content, i.e., the screen SC11, and the listening position O.

Therefore, the content creator can use the speakers displayed on the POV image P21 or the overhead image P22 as auxiliary information for adjusting the position of the audio object, that is, the position of the localization position mark, and arrange the localization position mark at a more appropriate position.

For example, when the content creator creates commercial content, the content creator often uses, as a reference, a speaker layout such as 22.2 channels in which speakers are densely arranged. In this case, for example, it is sufficient if the content creator selects 22.2 channel as the channel configuration and displays the speakers of the channels on the POV image P21 or the overhead image P22.

On the other hand, for example, in a case where the content creator is a general user, the content creator often uses a speaker layout such as 7.1 channel in which speakers are coarsely arranged. In this case, for example, it is sufficient if the content creator selects 7.1 channel as the channel configuration and displays the speakers of the channels on the POV image P21 or the overhead image P22.

In a case where a speaker layout in which speakers are coarsely arranged, such as 7.1 channel, is used, depending on the position where the sound image of the sound of the audio object is localized, there is a possibility that there is no speaker near that position and the localization of the sound image is blurred. In order to localize the sound image clearly, it is preferable that the localization position mark position be arranged near the speaker.

As described above, in the content creation tool, an arbitrary one is selected as the channel configuration of the speaker system, and each speaker of the speaker system having the selected channel configuration can be displayed on the POV image P21 or the overhead image P22.

Therefore, the content creator uses the speaker displayed on the POV image P21 or the overhead image P22 as auxiliary information in accordance with the speaker layout assumed by the content creator, and can arrange the localization position mark at a more appropriate position such as a position near the speaker. That is, the content creator can visually grasp the influence of the speaker layout on the sound image localization of the audio object, and appropriately adjust the arrangement position of the localization position mark while considering the positional relationship with the video and the speaker.

Moreover, the content creation tool can specify a localization position mark for each audio track at each reproduction time of the audio track (audio data).

Figure 10:
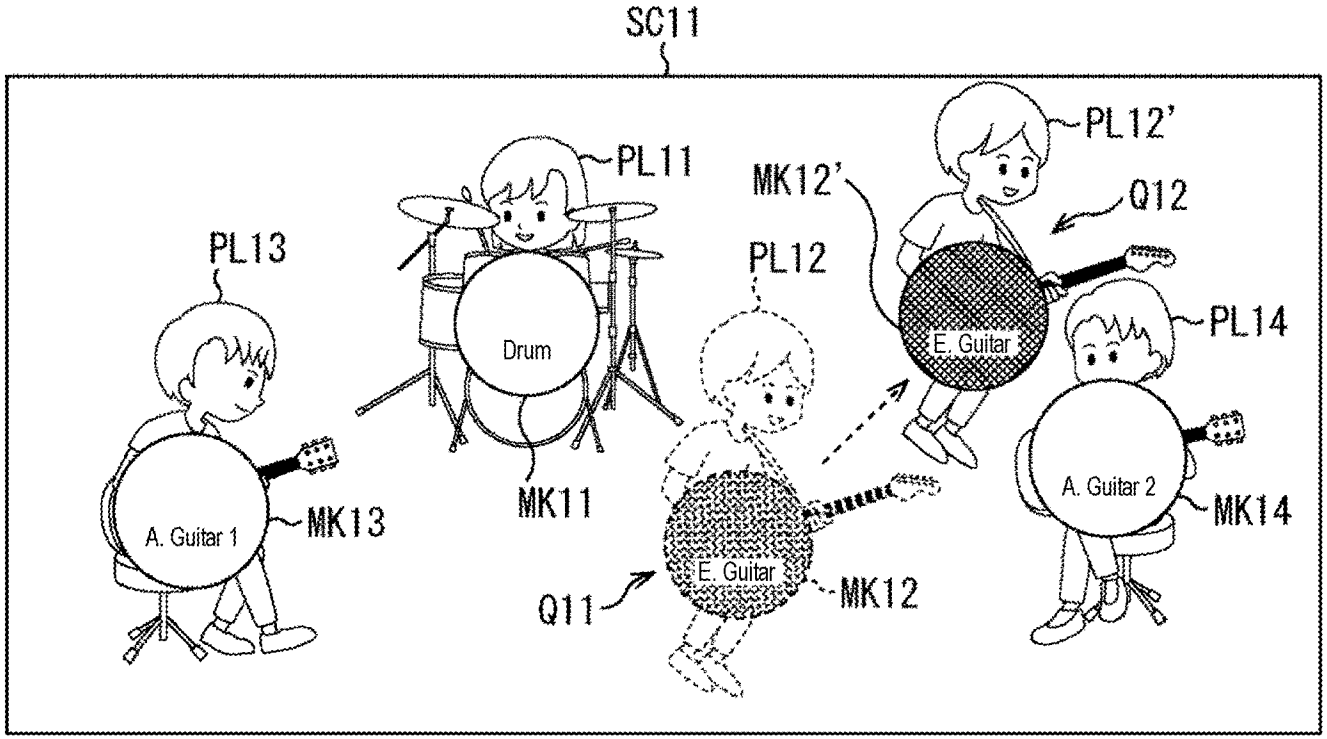
FIG. 10 is a diagram explaining interpolation of position information.

For example, as illustrated in FIG. 10, it is assumed that the position of the localization position mark MK12 changes at a predetermined reproduction time t1 and a subsequent reproduction time t2 in accordance with the movement of the performer PL12 of the electric guitar. Note that portions in FIG. 10 corresponding to those of FIG. 6 are designated by the same reference numerals, and description is omitted as appropriate.

In FIG. 10, a performer PL12' and a localization position mark MK12' represent the performer PL12 and the localization position mark MK12 at the reproduction time t2.

For example, it is assumed that the performer PL12 of the electric guitar is located at the position indicated by arrow Q11 at the predetermined reproduction time t1 on the video of the content, and the content creator has arranged the localization position mark MK12 at the same position as that of the performer PL12.

Furthermore, it is assumed that, at the reproduction time t2 after the reproduction time t1, the performer PL12 of the electric guitar has moved to the position indicated by arrow Q12 on the video of the content, and at the reproduction time t2, the content creator has arranged the localization position mark MK12' at the same position as that of the performer PL12'.

Here, it is assumed that the content creator has not particularly specified the position of the localization position mark MK12 at another reproduction time between the reproduction time t1 and the reproduction time t2.

In such a case, the localization position determination unit 41 performs interpolation processing to determine the position of the localization position mark MK12 at another reproduction time between the reproduction time t1 and the reproduction time t2.

At the time of the interpolation processing, for example, on the basis of the position information indicating the position of the localization position mark MK12 at the reproduction time t1 and the position information indicating the position of the localization position mark MK12' at the reproduction time t2, regarding each of three components: the horizontal angle, the vertical angle, and the radius as the position information, the value of each component of the position information indicating the position of the localization position mark MK12 at reproduction time subjected to linear interpolation is obtained.

Note that, as described above, even in a case where the position information is represented by coordinates in a three-dimensional rectangular coordinate system, similarly to the case where the position information is represented in a polar coordinate, linear interpolation is performed for each component of coordinates such as x coordinate, y coordinate, and z coordinate.

In this way, when the position information of the localization position mark MK12 at another reproduction time between the reproduction time t1 and the reproduction time t2 is obtained by interpolation processing, at the time of content reproduction, the localization position of the sound image of the sound of the electric guitar, that is, the sound of the audio object also moves according to the movement of the position of the performer PL12 of the electric guitar on the video. Therefore, it is possible to obtain natural content in which the sound image position moves smoothly without a sense of discomfort.

<Description of the Localization Position Determination Processing>

Figure 11:
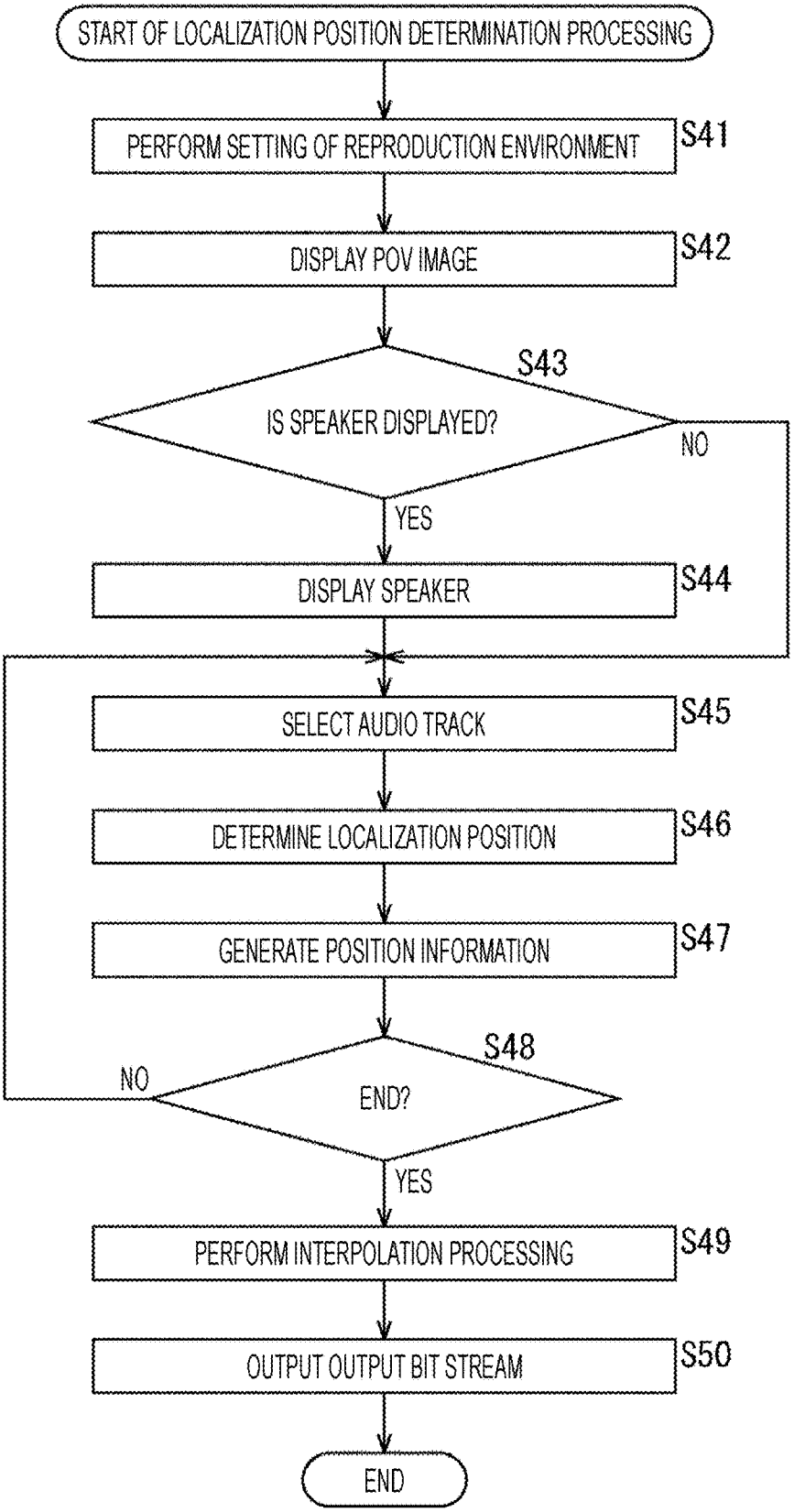
FIG. 11 is a flowchart explaining localization position determination processing.

Next, as described with reference to FIGS. 6 to 10, the operation of the signal processing apparatus 11 in a case where the present technology has been applied to object-based audio. That is, the localization position determination processing by the signal processing apparatus 11 will be described below with reference to the flowchart in FIG. 11.

In step S41, the control unit 23 sets a reproduction environment.

For example, when the content creation tool is activated, the content creator operates the input unit 21 to specify the setting parameters illustrated in FIG. 5. Then, the control unit 23, on the basis of a signal supplied from the input unit 21 in response to the operation of content creator, determines the setting parameters.

Therefore, for example, the size of the listening space, the listening position in the listening space, the size and aspect ratio of the screen on which the video of the content is displayed, the arrangement position of the screen in the listening space, and the like are determined.

In step S42, the display control unit 43 controls the display unit 24 on the basis of the setting parameters determined in step S41 and the image data of the video of the content, and causes the display unit 24 to display a display screen including the POV image.

Thus, for example, the window WD11 including the POV image P21 and the overhead image P22 illustrated in FIG. 6 is displayed.

At this time, according to the setting parameters set in step S41, the display control unit 43 draws a wall or the like of the listening space (room) in the POV image P21 and the overhead image P22 or displays the screen SC11 having a size determined by the setting parameters at a position determined by the setting parameters. Furthermore, the display control unit 43 causes the video of the content to be displayed at the position of the screen SC11.

Furthermore, in the content creation tool, it is possible to select whether or not to display a speaker constituting the speaker system, more specifically an image simulating the speaker, on the POV image and the overhead image, or a channel configuration of the speaker system in a case where the speaker is displayed. The content creator operates the input unit 21 as necessary, to give an instruction on whether or not to display the speaker or to select a channel configuration of the speaker system.

In step S43, the control unit 23 determines whether or not to display a speaker on the POV image and the overhead image on the basis of the signal or the like supplied from the input unit 21 in response to the operation by the content creator.

In a case where it is determined not to display the speaker in step S43, the processing of step S44 is not performed, and thereafter the processing proceeds to step S45.

On the other hand, in a case where it is determined in step S43 that the speaker is to be displayed, thereafter the processing proceeds to step S44.

In step S44, the display control unit 43 causes the display unit 24 to display each speaker of the speaker system having the channel configuration selected by the content creator on the POV image and the overhead image in the speaker layout of the channel configuration. Thus, for example, a speaker SP11 and speaker SP12 illustrated in FIG. 9 are displayed on the POV image P21 and overhead image P22.

When the speaker has been displayed by the processing in step S44 or when it is determined in step S43 that the speaker is not displayed, in step S45, the localization position determination unit 41 selects the audio track to be adjusted for the localization position of the sound image on the basis of the signal supplied from the input unit 21.

Figure 4:
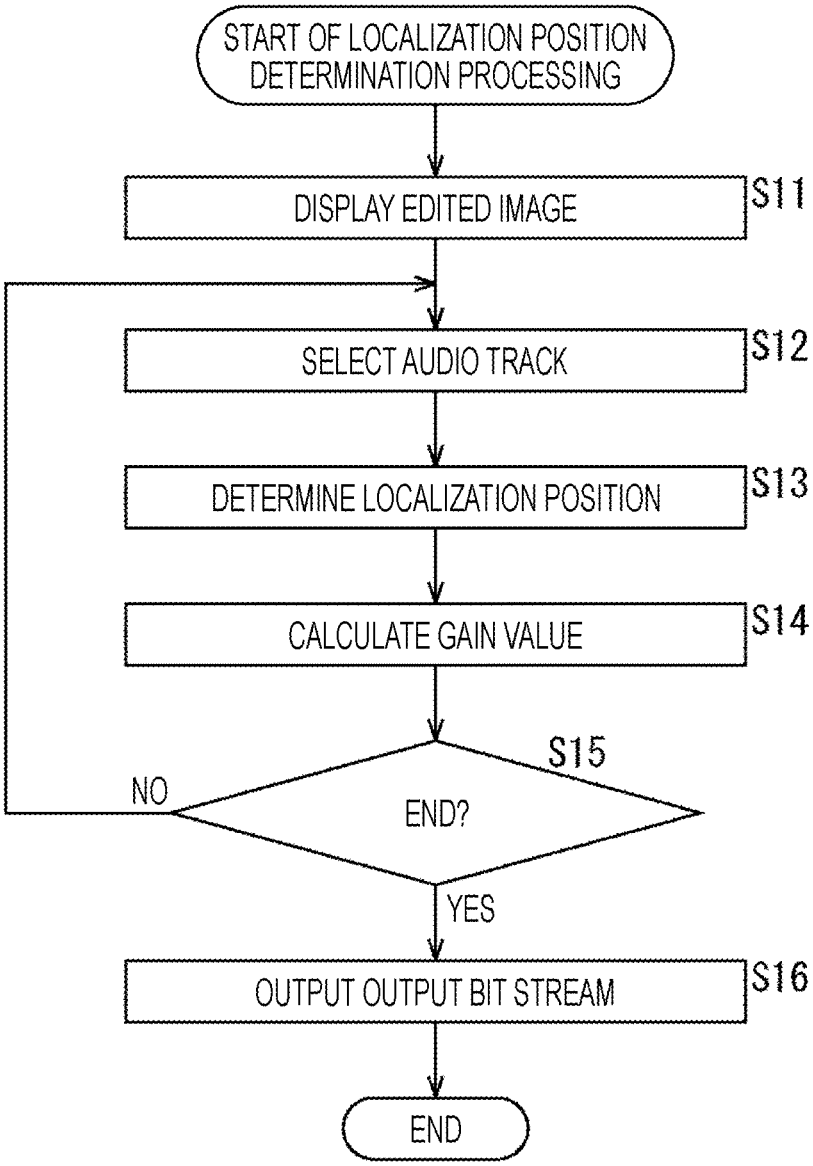
FIG. 4 is a flowchart explaining localization position determination processing.

For example, in step S45, the processing similar to that of step S12 of FIG. 4 is performed, predetermined reproduction time in the desired audio track is selected as a target for adjustment of the sound image localization.

After selecting the target for adjustment of the sound image localization, the content creator subsequently operates the input unit 21 to move the arrangement position of the localization position mark in the listening space to an arbitrary position and specifies the sound image localization position of the sound of the audio track corresponding to the localization position mark.

At this time, the display control unit 43 causes the display unit 24, on the basis of the signal supplied from the input unit 21 in response to the input operation of the content creator, to move the display position of the localization position mark.

In step S46, the localization position determination unit 41, on the basis of the signal supplied from the input unit 21, determines the localization position of the sound image of the sound of the audio track to be adjusted.

That is, the localization position determination unit 41 acquires information (signal) indicating the position of the localization position mark viewed from the listening position on the listening space from the input unit 21, and determines the position indicated by the acquired information as the localization position of the sound image.

In step S47, the localization position determination unit 41 generates position information indicating the localization position of the sound image of the sound of the audio track to be adjusted on the basis of the result of determination in step S46. For example, the position information is information represented by polar coordinates based on the listening position.

The position information generated in this way is position information indicating the position of the audio object corresponding to the audio track to be adjusted. That is, the position information obtained in step S47 is meta information of the audio object.

Note that the position information as meta information may be polar coordinates as described above, i.e., horizontal angle, vertical angle, and radius, or may be a rectangular coordinate. In addition, the setting parameters indicating the position and size of the screen, the arrangement position, and the like set in step S41 may also be meta information of the audio object.

In step S48, the control unit 23 determines whether or not to end the adjustment of the localization position of the sound image. For example, in step S48, the determination processing similar to the case of step S15 in FIG. 4 is performed.

In a case where it is determined in step S48 that the adjustment of the localization position of the sound image is not yet to be ended, the processing returns to step S45, and the above-described processing is repeated. That is, the localization position of the sound image is adjusted for the newly selected audio track. Note that, in this case, in a case where the setting of whether or not to display the speaker is changed, the speaker is displayed or the speaker is not displayed according to the change.

On the other hand, in a case where it is determined in step S48 that the adjustment of the localization position of the sound image is to be ended, the processing proceeds to step S49.

In step S49, the localization position determination unit 41 appropriately performs interpolation processing on each audio track, and obtains the localization position of the sound image at the reproduction time for the reproduction time for which the localization position of the sound image is not specified.

For example, as described with reference to FIG. 10, for a predetermined audio track, the position of the localization position mark at the reproduction time t1 and the reproduction time t2 is specified by the content creator, and it is assumed that the position of the localization position mark has not been specified for the other reproduction time between the reproduction times. In this case, the position information is generated for the reproduction time t1 and the reproduction time t2 by the processing of step S47, but the position information is in a state of being not generated for the other reproduction time between the reproduction time t1 and the reproduction time t2.

Therefore, the localization position determination unit 41 performs interpolation processing such as linear interpolation on the basis of the position information at the reproduction time t1 and the position information at the reproduction time t2 for the predetermined audio track, and generates the position information at the other reproduction time. By performing such interpolation processing for each audio track, the position information can be obtained for all reproduction times of all audio tracks. Note that, in the localization position determination processing described with reference to FIG. 4, the interpolation processing similar to that of step S49 may be performed to obtain the position information of an unspecified reproduction time.

In step S50, the control unit 23 outputs an output bit stream based on the position information of each audio object, that is, an output bit stream based on the position information obtained in the processing of step S47 or step S49, and the localization position determination processing ends.

For example, in step S50, the control unit 23 performs rendering by the VBAP method on the basis of the position information obtained as the meta information of the audio object and each audio track, and generates audio data of each channel having a predetermined channel configuration.

Then, the control unit 23 outputs an output bit stream including the obtained audio data. Here, the output bit stream may include image data of the video of the content.

Similarly to the case of the localization position determination processing described with reference to FIG. 4, the output destination of the output bit stream can be an arbitrary output destination such as the recording unit 22, the speaker unit 26, or an external device.

That is, for example, an output bit stream including the audio data and the image data of the content may be supplied to and recorded on the recording unit 22, a removable recording medium, or the like, or audio data as an output bit stream may be supplied to the speaker unit 26 and the sound of the content may be reproduced.

Furthermore, the rendering processing is not performed, and the position information obtained in step S47 or step S49 is used as meta information indicating the position of the audio object, an output bit stream including at least audio data of the audio data, the image data of the content, and meta information may be generated.

At this time, the audio data, the image data, and the meta information are appropriately encoded by the control unit 23 according to a predetermined encoding method, and an encoded bit stream including the encoded audio data, image data, and meta information may be generated as an output bit stream.

In particular, this output bit stream may be supplied to and recorded on the recording unit 22 or the like, or may be supplied to the communication unit 25, and the output bit stream may be transmitted to an external device by the communication unit 25.

As described above, the signal processing apparatus 11 displays the POV image, moves the localization position mark according to the operation of the content creator, and determines the localization position of the sound image on the basis of the display position of the localization position mark.

In this way, the content creator can easily determine (specify) an appropriate localization position of the sound image simply by performing an operation of moving the localization position mark to a desired position while viewing the POV image.

As described above, according to the present technology, for audio content of left and right two channels, and particularly for content of object-based audio that targets sound image localization in a three-dimensional space, it is possible to easily set the panning to localize the sound image at a specific position on a video, for example, or the position information of the audio object in the content creation tool.

<Configuration Example of Computer>

Incidentally, the series of processing described above can be executed by hardware and it can also be executed by software. In a case where the series of processing is executed by software, a program constituting the software is installed in a computer. Here, the computer includes a computer mounted in dedicated hardware, for example, a general-purpose a personal computer that can execute various functions by installing the various programs, or the like.

Figure 12:
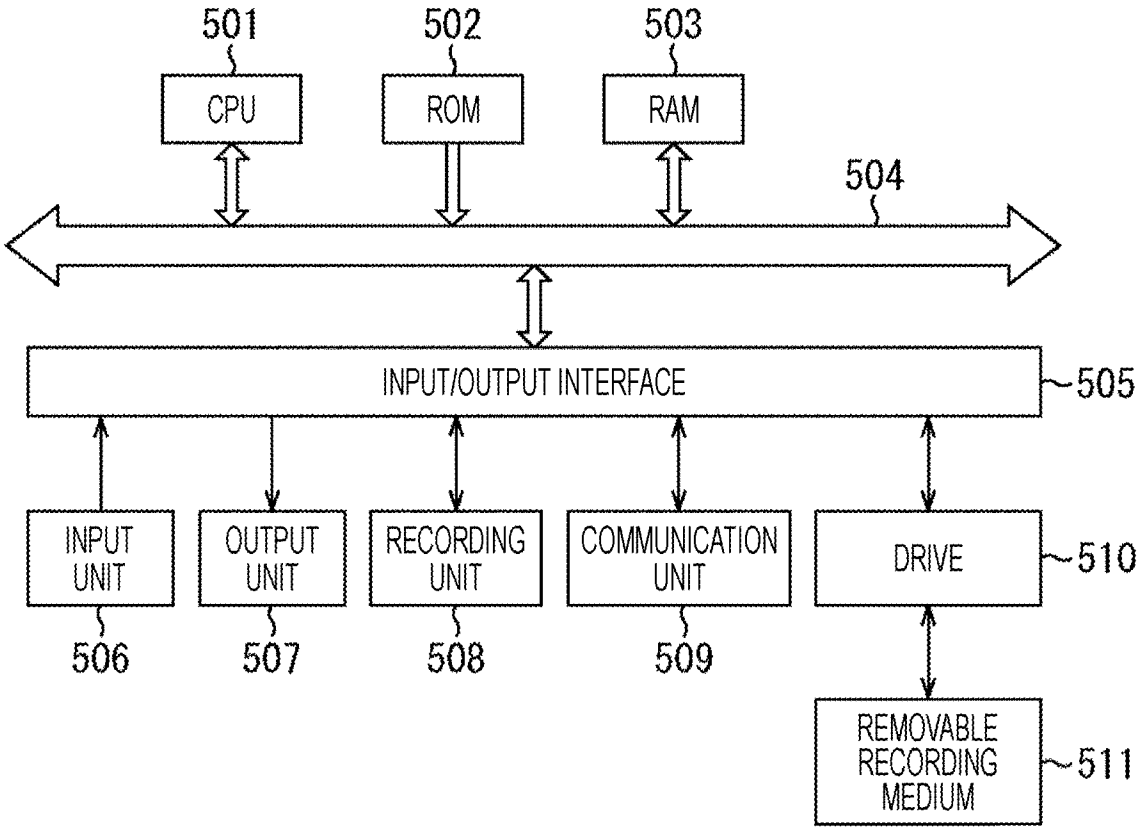
FIG. 12 is a diagram illustrating a configuration example of a computer.

FIG. 12 is a block diagram illustrating a configuration example of hardware of a computer in which the series of processing described above is executed by a program.

In the computer, a central processing unit (CPU) 501, a read only memory (ROM) 502, a random access memory (RAM) 503, are interconnected by a bus 504.

An input/output interface 505 is further connected to the bus 504. An input unit 506, an output unit 507, a recording unit 508, a communication unit 509, and a drive 510 are connected to the input/output interface 505.

The input unit 506 includes a keyboard, a mouse, a microphone, an image sensor, and the like. The output unit 507 includes a display, a speaker, and the like. The recording unit 508 includes a hard disk, a non-volatile memory, and the like. The communication unit 509 includes a network interface and the like. The drive 510 drives a removable recording medium 511 such as a magnetic disk, an optical disk, a magneto-optical disk, or a semiconductor memory.

In the computer configured in the manner described above, the series of processing described above is performed, for example, such that the CPU 501 loads a program stored in the recording unit 508 into the RAM 503 via the input/output interface 505 and the bus 504 and executes the program.

The program to be executed by the computer (CPU 501) can be provided by being recorded on the removable recording medium 511, for example, as a package medium or the like. Furthermore, the program can be provided via a wired or wireless transmission medium such as a local area network, the Internet, or digital satellite broadcasting.

In the computer, the program can be installed on the recording unit 508 via the input/output interface 505 when the removable recording medium 511 is mounted on the drive 510. Furthermore, the program can be received by the communication unit 509 via a wired or wireless transmission medium and installed on the recording unit 508. In addition, the program can be pre-installed on the ROM 502 or the recording unit 508.

Note that the program executed by the computer may be a program that is processed in chronological order along the order described in the present description or may be a program that is processed in parallel or at a required timing, e.g., when call is carried out.

Furthermore, the embodiment of the present technology is not limited to the aforementioned embodiments, but various changes may be made within the scope not departing from the gist of the present technology.

For example, the present technology can adopt a configuration of cloud computing in which one function is shared and jointly processed by a plurality of apparatuses via a network.

Furthermore, each step described in the above-described flowcharts can be executed by a single apparatus or shared and executed by a plurality of apparatuses.

Moreover, in a case where a single step includes a plurality of pieces of processing, the plurality of pieces of processing included in the single step can be executed by a single device or can be divided and executed by a plurality of devices.

Moreover, the present technology may be configured as below.

(1)

A signal processing apparatus including:

an acquisition unit configured to acquire information associated with a localization position of a sound image of an audio object in a listening space specified in a state where the listening space viewed from a listening position is displayed; and a generation unit configured to generate a bit stream on the basis of the information associated with the localization position.

(2)

The signal processing apparatus according to (1), in which the generation unit generates the bit stream by treating the information associated with the localization position as meta information of the audio object.

(3)

The signal processing apparatus according to (2), in which the bit stream includes audio data and the meta information of the audio object.

(4)

The signal processing apparatus according to any one of (1) to (3), in which the information associated with the localization position is position information indicating the localization position in the listening space.

(5)

The signal processing apparatus according to (4), in which the position information includes information indicating a distance from the listening position to the localization position.

(6)

The signal processing apparatus according to (4) or (5), in which the localization position is a position on a screen that displays a video arranged in the listening space.

(7)

The signal processing apparatus according to any one of (4) to (6), in which the acquisition unit acquires, on the basis of the position information at a first time and the position information at a second time, the position information at a third time between the first time and the second time by interpolation processing.

(8)

The signal processing apparatus according to any one of (1) to (7), further including a display control unit configured to control display of an image of the listening space viewed from the listening position or a position near the listening position.

(9)

The signal processing apparatus according to (8), in which the display control unit causes each speaker of a speaker system of a predetermined channel configuration to be displayed on the image in a speaker layout of the predetermined channel configuration.

(10)

The signal processing apparatus according to (8) or (9), in which the display control unit causes a localization position mark indicating the localization position to be displayed on the image.

(11)

The signal processing apparatus according to (10), in which the display control unit causes a display position of the localization position mark to be moved in response to an input operation.

(12)

The signal processing apparatus according to any one of (8) to (11), in which the display control unit causes a screen on which a video arranged in the listening space and including a subject corresponding to the audio object is displayed to be displayed on the image.

(13)

The signal processing apparatus according to any one of (8) to (12), in which the image is a POV image.

(14)

A signal processing method, by a signal processing apparatus, including:

acquiring information associated with a localization position of a sound image of an audio object in a listening space specified in a state where the listening space viewed from a listening position is displayed; and generating a bit stream on the basis of the information associated with the localization position.

(15)

A program causing a computer to execute processing including the steps of:

acquiring information associated with a localization position of a sound image of an audio object in a listening space specified in a state where the listening space viewed from a listening position is displayed; and generating a bit stream on the basis of the information associated with the localization position.

REFERENCE SIGNS LIST

11 Signal processing apparatus
21 Input unit
23 Control unit
24 Display unit
25 Communication unit
26 Speaker unit
41 Localization position determination unit
42 Gain calculation unit
43 Display control unit

The invention claimed is:

1. A signal processing apparatus comprising:

processing circuitry configured to:

display a listening space image on a display screen, the listening space image including sound images of audio objects and localization position marks corresponding to the sound images, wherein the sound images correspond to audio tracks, and wherein the listening space image indicates positions of the sound images in a listening space;

receive a selection of a sound image of the displayed sound images based on selection by a user of an audio track of the audio tracks;

move a position of the localization position mark corresponding to the selected sound image on the display screen in response to a user operation;

determine a localization position of the selected sound image relative to a listening position in the listening space based on a position of the moved localization position mark on the image, wherein the localization position of the selected sound image is determined using coordinates of a coordinate system having the listening position in the listening space as an origin;

calculate gain values of audio channels based on the determined localization position of the selected sound image and positions of speakers relative to the listening position; and generate a bit stream on a basis of information associated with the determined localization position, the bit stream including the calculated gain values, wherein the bit stream is generated by treating the information associated with the localization position as meta information of the selected sound image, wherein the meta information includes position coordinates of the selected sound image, and wherein the listening space image displayed on the display screen includes a point of view image of the listening space as viewed from the listening position and an overhead image of the listening space as viewed from above.

2. The signal processing apparatus according to claim 1, wherein the bit stream includes audio data and the meta information of the selected sound image.

3. The signal processing apparatus according to claim 1, wherein the localization position is a position on the display screen that displays a video arranged in the listening space.

4. The signal processing apparatus according to claim 1, wherein the processing circuitry is configured to determine, on a basis of position information at a first time and position information at a second time, position information at a third time between the first time and the second time by interpolation processing.

5. The signal processing apparatus according to claim 1, wherein the processing circuitry is configured to cause a representation of each speaker of a speaker system of a predetermined channel configuration to be displayed on the listening space image in a speaker layout of the predetermined channel configuration.

6. The signal processing apparatus according to claim 1, wherein the processing circuitry is configured to cause a screen on which a video arranged in the listening space and including a subject corresponding to the audio object is displayed to be displayed on the listening space image.

7. The signal processing apparatus according to claim 1, wherein the listening space image includes image regions that display representations of respective ones of the sound images.

8. A signal processing method, by a signal processing apparatus, comprising:

displaying a listening space image on a display screen, the listening space image including sound images of audio objects and localization position marks corresponding to the sound images, wherein the sound images correspond to audio tracks, and wherein the listening space image indicates positions of the sound images in a listening space;

receiving a selection of a sound image of the displayed sound images based on selection by a user of an audio track of the audio tracks;

moving a position of the localization position mark corresponding to the selected sound image on the display screen in response to a user operation;

determining a localization position of the selected sound image relative to a listening position in the listening space based on a position of the moved localization position mark on the image, wherein the localization position of the selected sound image is determined using coordinates of a coordinate system having the listening position in the listening space as an origin;

calculating gain values of audio channels based on the determined localization position of the selected sound image and positions of speakers relative to the listening position; and generating a bit stream on a basis of information associated with the determined localization position, the bit stream including the calculated gain values, wherein the bit stream is generated by treating the information associated with the localization position as meta information of the selected sound image, wherein the meta information includes position coordinates of the selected sound image, and wherein the listening space image displayed on the display screen includes a point of view image of the listening space as viewed from the listening position and an overhead image of the listening space as viewed from above.

9. The signal processing method according to claim 8, wherein the listening space image includes image regions that display representations of respective ones of the sound images.

10. A non-transitory computer readable medium containing instructions that, when executed by processing circuitry, perform a signal processing method comprising:

displaying a listening space image on a display screen, the listening space image including sound images of audio objects and localization position marks corresponding to the sound images, wherein the sound images correspond to audio tracks, and wherein the listening space image indicates positions of the sound images in a listening space;

receiving a selection of a sound image of the displayed sound images based on selection by a user of an audio track of the audio tracks;

moving a position of the localization position mark corresponding to the selected sound image on the display screen in response to a user operation;

determining a localization position of the selected sound image relative to a listening position in the listening space based on a position of the moved localization position mark on the image, wherein the localization position of the selected sound image is determined using coordinates of a coordinate system having the listening position in the listening space as an origin;

calculating gain values of audio channels based on the determined localization position of the selected sound image and positions of speakers relative to the listening position; and generating a bit stream on a basis of information associated with the determined localization position, the bit stream including the calculated gain values, wherein the bit stream is generated by treating the information associated with the localization position as meta information of the selected sound image, wherein the meta information includes position coordinates of the selected sound image, and wherein the listening space image displayed on the display screen includes a point of view image of the listening space as viewed from the listening position and an overhead image of the listening space as viewed from above.

11. The non-transitory computer readable medium according to claim 10, wherein the listening space image includes image regions that display representations of respective ones of the sound images.

* * * * *